US010225671B2

(12) United States Patent
Goorevich et al.

(10) Patent No.: US 10,225,671 B2
(45) Date of Patent: Mar. 5, 2019

(54) TINNITUS MASKING IN HEARING PROSTHESES

(71) Applicant: Cochlear Limited, Macquarie University, NSW (AU)

(72) Inventors: Michael Goorevich, Naremburn (AU); Phyu Phyu Khing, North Sydney (AU); Matthijs Johannes Petrus Killian, Mechelen (BE); Bastiaan Van Dijk, Deurne (Antwerp) (BE)

(73) Assignee: Cochlear Limited, Macquarie University (AU)

( * ) Notice: Subject to any disclaimer, the term of this patent is extended or adjusted under 35 U.S.C. 154(b) by 47 days.

(21) Appl. No.: 15/166,691

(22) Filed: May 27, 2016

(65) Prior Publication Data

US 2017/0347213 A1 Nov. 30, 2017

(51) Int. Cl.
*H04R 25/00* (2006.01)

(52) U.S. Cl.
CPC ..... *H04R 25/75* (2013.01); *H04R 25/356* (2013.01); *H04R 25/43* (2013.01); *H04R 25/505* (2013.01); *H04R 2460/01* (2013.01)

(58) Field of Classification Search
CPC ..... H04R 25/75; H04R 25/356; H04R 25/43; H04R 25/505; A61F 11/04; A61B 5/128; A61M 21/00
See application file for complete search history.

(56) References Cited

U.S. PATENT DOCUMENTS 5,403,262 A * 4/1995 Gooch ..... A61B 5/12 600/28
5,795,287 A 8/1998 Ball et al.
(Continued)

FOREIGN PATENT DOCUMENTS

KR 10-2015-0007813 1/2015
WO 02/096154 A1 11/2002
(Continued)

OTHER PUBLICATIONS

Sergie Kochkin, Ph.D., Richard Tyler, Ph.D., Jennifer Born, "Marke Trak VIII: The Prevalence of Tinnitus in the United States and the Self-Reported Efficacy of Various Treatments", The Hearing Review, Nov. 11, 2011.
(Continued)

*Primary Examiner* — Sunita Joshi
(74) *Attorney, Agent, or Firm* — Edell, Shapiro & Finnan, LLC

(57) ABSTRACT

Presented herein are techniques for providing tinnitus relief to recipients of a hearing prosthesis. In accordance with embodiments presented herein, a hearing prosthesis comprises a tinnitus relief system that is configured to generate a tinnitus masker signal that comprises a plurality of discrete (separate) components. The tinnitus relief system is configured to inject the components of the tinnitus masker signal directly into a sound processing path so that the masker components are combined with different processed portions of a channelized sound signal. The channelized sound signal and the components of the tinnitus masker signal are used to generate one or more output signals for use in compensation of a hearing loss of a recipient of the hearing prosthesis.

30 Claims, 18 Drawing Sheets

(56) References Cited

U.S. PATENT DOCUMENTS

| | | | | |
|---|---|---|---|---|
| 5,814,095 | A * | 9/1998 | Muller | H04R 1/08 607/56 |
| 6,047,074 | A * | 4/2000 | Zoels | A61B 5/128 381/313 |
| 6,394,947 | B1 | 5/2002 | Leysieffer | |
| 2004/0230254 | A1 | 11/2004 | Harrison et al. | |
| 2010/0121411 | A1 | 5/2010 | Hochmair et al. | |
| 2011/0046435 | A1* | 2/2011 | Jensen | H04R 25/75 600/28 |
| 2012/0046713 | A1 | 2/2012 | Hannemann et al. | |
| 2013/0039517 | A1 | 2/2013 | Nielsen et al. | |
| 2015/0256948 | A1* | 9/2015 | Nielsen | H04R 25/75 381/320 |
| 2016/0366527 | A1* | 12/2016 | Jones | H04R 25/75 |

FOREIGN PATENT DOCUMENTS

| | | | | |
|---|---|---|---|---|
| WO | WO 2004105431 | A2 * | 12/2004 | H04R 25/30 |
| WO | 2007/091180 | A2 | 8/2007 | |
| WO | 2010/042463 | A1 | 4/2010 | |
| WO | 2014/206446 | A1 | 12/2014 | |

OTHER PUBLICATIONS

"Vagus Nerve Stimulation for Tinnitus", UT Dallas research project report and web page. http://www.utdallas.edu/ctech/projects-overview/vagus-nerve-stimulation-for-tinnitus/, May 26, 2016.

Padraig Rushe, Irish engineers create medical device to treat tinnitus, Engineers Journal, http://www.engineersjournal.ie/irish-engineers-create-medical-device-treat-tinnitus/, Sep. 29, 2014.

Tyler R.S., Keiner A.J., Walker K., Deshpande A.K., Witt S., Killian M., Ji H., Patrick J., Dillier N., van Dijk P., Lai W.K., Hansen M.R., Gantz B. (2015) A Series of Case Studies of Tinnitus Suppression With Mixed Background Stimuli in a Cochlear Implant, American Journal of Audiology, vol. 24, Sep. 2015, pp. 398-410.

Hoare D.J., Searchfield G.D., El Refaie A., Henry J.A. (2014) Sound therapy for tinnitus management: practicable options. J Am Acad Audiol. 25(1):62-75.

International Search Report and Written Opinion in counterpart International Application No. PCT/IB2017/052913, dated Aug. 18, 2017, 11 pages.

* cited by examiner

TINNITUS MASKING IN HEARING PROSTHESES

BACKGROUND

Field of the Invention

The present invention relates generally to hearing prostheses.

Related Art

Hearing loss, which may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals who suffer from conductive hearing loss typically have some form of residual hearing because the hair cells in the cochlea are undamaged. As such, individuals suffering from conductive hearing loss typically receive an auditory prosthesis that generates motion of the cochlea fluid. Such auditory prostheses include, for example, acoustic hearing aids, bone conduction devices, and direct acoustic stimulators.

In many people who are profoundly deaf, however, the reason for their deafness is sensorineural hearing loss. Those suffering from some forms of sensorineural hearing loss are unable to derive suitable benefit from auditory prostheses that generate mechanical motion of the cochlea fluid. Such individuals can benefit from implantable auditory prostheses that stimulate nerve cells of the recipient's auditory system in other ways (e.g., electrical, optical and the like). Cochlear implants are often proposed when the sensorineural hearing loss is due to the absence or destruction of the cochlea hair cells, which transduce acoustic signals into nerve impulses. An auditory brainstem stimulator is another type of stimulating auditory prosthesis that might also be proposed when a recipient experiences sensorineural hearing loss due to damage to the auditory nerve.

Certain individuals suffer from only partial sensorineural hearing loss and, as such, retain at least some residual hearing. These individuals may be candidates for electro-acoustic hearing prostheses that deliver both electrical and acoustical stimulation.

SUMMARY

In one aspect, a hearing prosthesis is provided. The hearing prosthesis comprises: at least one sound processing path that converts a sound signal into one or more output signals for use in compensation of a hearing loss of a recipient of the hearing prosthesis; and a tinnitus relief system configured to inject a channelized tinnitus masker signal into the sound processing path such that the channelized tinnitus masker forms part of the one or more output signals.

In another aspect, a method performed at an electric output hearing prosthesis is provided. The method comprises: band-pass filtering a sound signal to generate a plurality of band-pass filtered signals; combining separate tinnitus relief signal components with each of a respective one of the plurality of band-pass filtered signals; and generating one or more output signals for use in energizing one or more electrodes of the electric output hearing prosthesis.

In another aspect, a sound processing unit is provided. The sound processor comprises: a plurality of band-pass filters configured to convert a sound signal into a plurality of channelized signals; and an output block configured to convert the plurality of channelized signals into a plurality of output signals, wherein a channelized tinnitus masker signal is applied to the channelized signals prior to conversion into the plurality of output signals.

BRIEF DESCRIPTION OF THE DRAWINGS

Embodiments of the present invention are described herein in conjunction with the accompanying drawings, in which.

DETAILED DESCRIPTION

Tinnitus is the perception of noise or "ringing" in the ears which currently affects an estimated 30 million people in the United States alone. Tinnitus is a common artefact of hearing loss, but may also be a symptom of other underlying conditions, such as ear injuries, circulatory system disorders, etc. Although tinnitus affects can range from mild to severe, almost one-quarter of those with tinnitus describe their tinnitus as disabling or nearly disabling.

Presented herein are techniques for providing tinnitus relief to recipients of a hearing prosthesis. In accordance with embodiments presented herein, a hearing prosthesis comprises a tinnitus relief system that is configured to generate a tinnitus masker signal that comprises a plurality of discrete (separate) components. The tinnitus relief system is configured to inject the components of the tinnitus masker signal directly into a sound processing path so that the masker components are combined with different processed portions of a channelized sound signal. The channelized sound signal and the components of the tinnitus masker signal are used to generate one or more output signals for use in compensation of a hearing loss of a recipient of the hearing prosthesis.

For ease of illustration, embodiments are primarily described herein with reference to one specific type of electric output auditory/hearing prosthesis, namely a cochlear implant. However, it is to be appreciated that the techniques presented herein may be used with other types of hearing prostheses, such as auditory brainstem stimulators, direct acoustic stimulators, bone conduction devices, electro-acoustic hearing prostheses, etc.

Figure 1A:
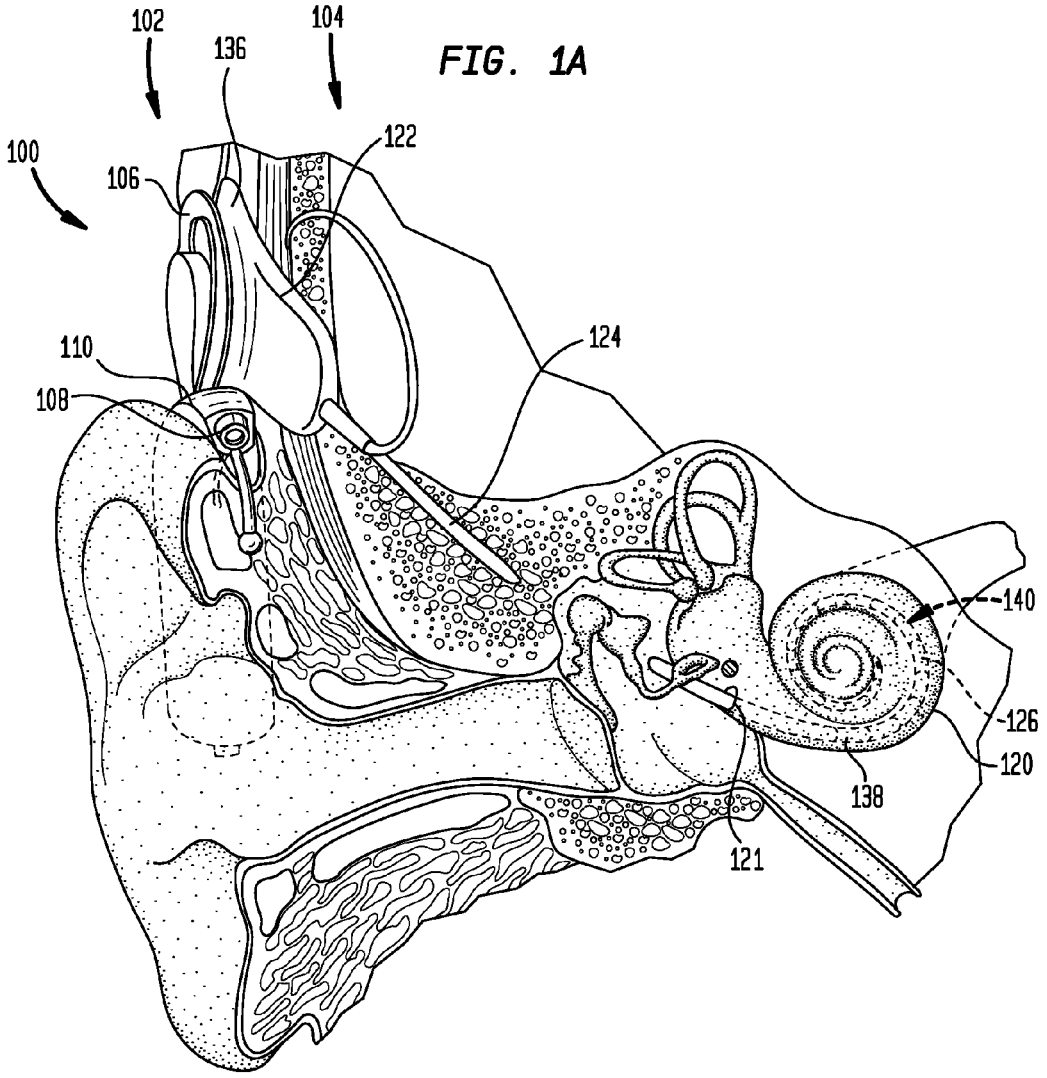
FIG. 1A is a schematic diagram illustrating a cochlear implant in accordance with embodiments presented herein.
Figure 1B:
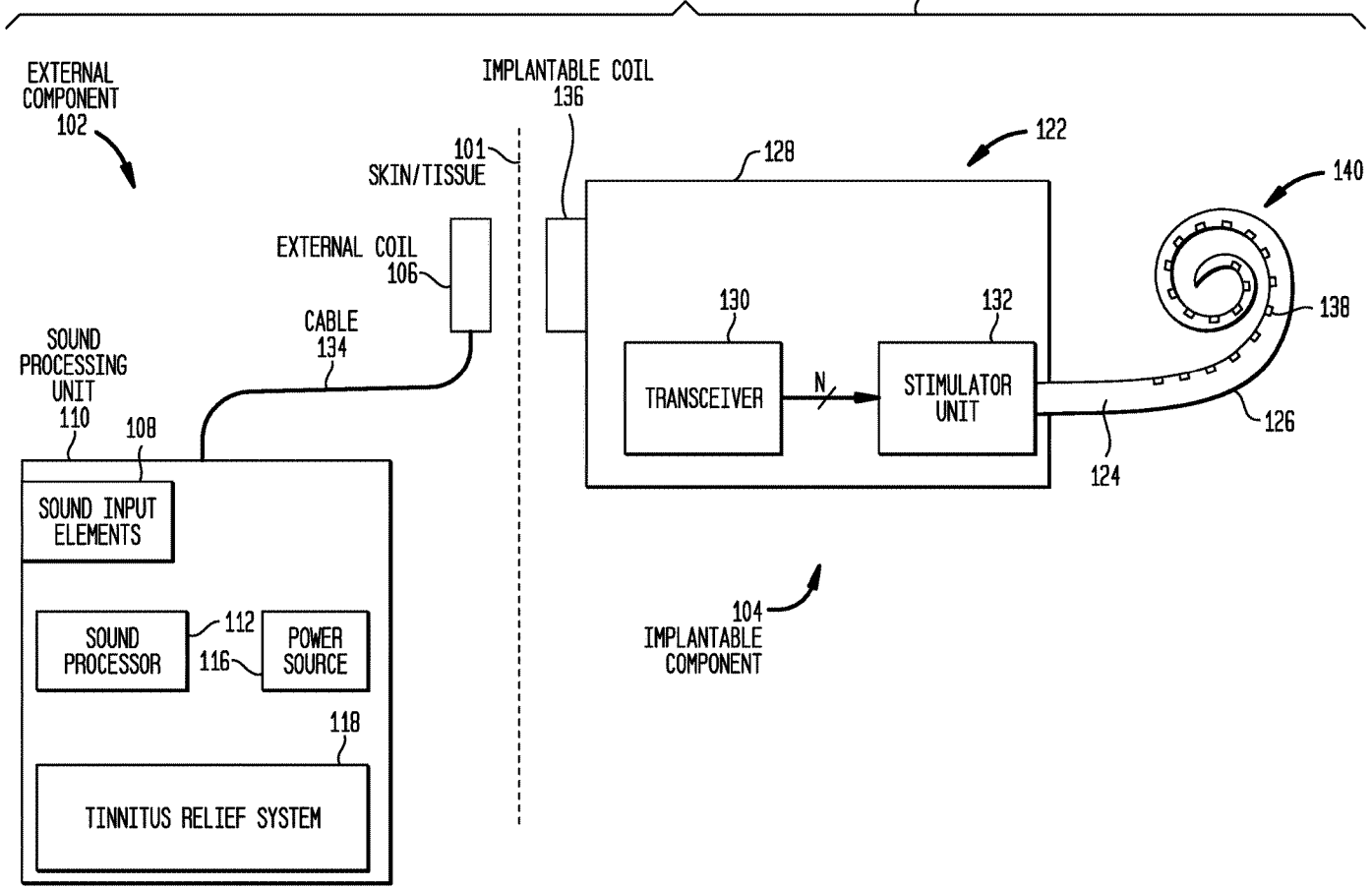
FIG. 1B is a block diagram of the cochlear implant of FIG. 1A.

FIG. 1A is schematic diagram of an exemplary cochlear implant 100 configured to implement embodiments of the present invention, while FIG. 1B is a block diagram of the cochlear implant 100. The cochlear implant 100 first comprises an external component 102.

The external component 102 is directly or indirectly attached to the body of the recipient and comprises a sound processing unit 110, an external coil 106 and, generally, a magnet (not shown in FIG. 1A) fixed relative to the external coil 106. The external coil 106 is connected to the sound processing unit 110 via a cable 134. The sound processing unit 110 comprises one or more sound input elements 108 (e.g., microphones, telecoils, etc.), a sound processor 112, a power source 116, and a tinnitus relief system 118. The sound processing unit 110 may be, for example, a behind-the-ear (BTE) sound processing unit, a body-worn sound processing unit, a button sound processing unit, etc.

As shown in FIG. 1B, the implantable component 104 comprises an implant body (main module) 122, a lead region 124, and an elongate intra-cochlear stimulating assembly 126. The implant body 122 generally comprises a hermetically-sealed housing 128 in which an internal transceiver unit (transceiver) 130 and a stimulator unit 132 are disposed. The implant body 122 also includes an internal/implantable coil 136 that is generally external to the housing 128, but which is connected to the transceiver 130 via a hermetic feedthrough (not shown in FIG. 1B). Implantable coil 136 is typically a wire antenna coil comprised of multiple turns of electrically insulated single-strand or multi-strand platinum or gold wire. The electrical insulation of implantable coil 136 is provided by a flexible molding (e.g., silicone molding), which is not shown in FIG. 1B. Generally, a magnet is fixed relative to the implantable coil 136.

Elongate stimulating assembly 126 is configured to be at least partially implanted in the recipient's cochlea 120 (FIG. 1B) and includes a plurality of longitudinally spaced intra-cochlear electrical stimulating contacts (electrodes) 138 that collectively form a contact array 140. In certain arrangements, the contact array 140 may include other types of stimulating contacts, such as optical stimulating contacts, in addition to the electrodes 138.

Stimulating assembly 126 extends through an opening 121 in the cochlea (e.g., cochleostomy, the round window, etc.) and has a proximal end connected to stimulator unit 132 via lead region 124 and a hermetic feedthrough (not shown in FIG. 1B). Lead region 124 includes a plurality of conductors (wires) that electrically couple the electrodes 138 to the stimulator unit 132.

Returning to external component 102, the sound input element(s) 108 are configured to detect/receive sound signals and to generate electrical signals therefrom. These signals, referred to herein as electrical input signals, are representative of the detected sound signals. The sound processor 112 is configured to execute sound processing and coding to convert the input signals generated by the sound input element(s) 108 into output data signals that represent electrical stimulation signals for delivery to the recipient.

The output data signals generated by the sound processor 112 are transcutaneously transferred to the cochlear implant 104 via external coil 106. More specifically, the magnets fixed relative to the external coil 106 and the implantable coil 136 facilitate the operational alignment of the external coil 106 with the implantable coil 136. This operational alignment of the coils enables the external coil 106 to transmit the coded data signals, as well as power signals received from power source 116, to the implantable coil 136. In certain examples, external coil 106 transmits the signals to implantable coil 136 via a radio frequency (RF) link. However, various other types of energy transfer, such as infrared (IR), electromagnetic, capacitive and inductive transfer, may be used to transfer the power and/or data from an external component to a cochlear implant and, as such, FIG. 1 illustrates only one example arrangement.

In general, the coded data signals received at implantable coil 136 are provided to the transceiver 130 and forwarded to the stimulator unit 132. The stimulator unit 132 is configured to utilize the coded data signals to generate stimulation signals (e.g., current signals) for delivery to the recipient's cochlea via one or of the electrodes 138. In this way, cochlear implant 100 stimulates the recipient's auditory nerve cells in a manner that causes the recipient to perceive the received sound signals by bypassing absent or defective hair cells that normally transduce acoustic vibrations into neural activity.

As noted, the sound processing unit 110 also includes a tinnitus relief system 118 (FIG. 1B). As described further below, the tinnitus relief system 118 is configured to generate a tinnitus relief signal that is designed to treat (i.e., mask, sooth, etc.) the recipient's tinnitus and/or to distract the recipient from the tinnitus sounds. The tinnitus relief signal comprises a plurality of discrete signal components and is sometimes referred to herein as a channelized tinnitus masker signal. That is, a tinnitus relief signal (channelized tinnitus masker signal) in accordance with embodiments presented herein comprises a plurality of discrete frequency bins of tinnitus masking signal components. The different signal components are injected directly into different sound processing channels of the cochlear implant's sound processing path.

Figure 2:
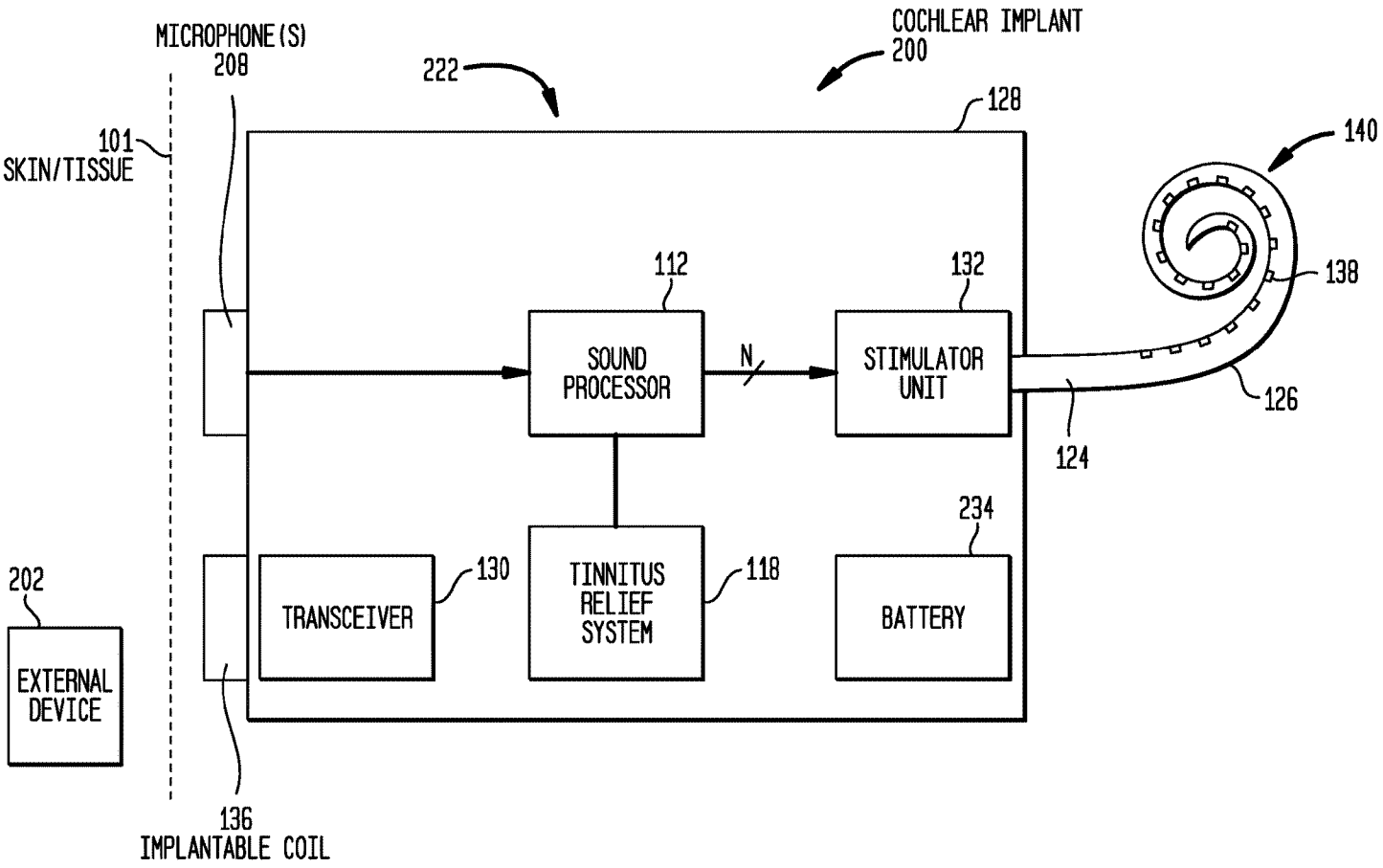
FIG. 2 is a block diagram of a totally implantable cochlear implant in accordance with embodiments presented herein.

FIGS. 1A and 1B illustrate an arrangement in which the cochlear implant 100 includes an external component 102. However, it is to be appreciated that embodiments of the present invention may be implemented in cochlear implants having alternative arrangements. For example, FIG. 2 is a functional block diagram of an exemplary totally implantable cochlear implant 200 configured to implement embodiments of the present invention. That is, in the example of FIG. 2, all components of the cochlear implant 200 are configured to be implanted under the skin/tissue 101 of the recipient. Because all components of cochlear implant 200 are implantable, cochlear implant 200 operates, for at least a finite period of time, without the need of an external device.

Cochlear implant 200 includes an implant body 222, lead region 124, and elongate intra-cochlear stimulating assembly 126. Similar to the example of FIG. 1B, the implant body 222 generally comprises a hermetically-sealed housing 128 in which transceiver 130 and stimulator unit 132 are disposed. However, in the specific arrangement of FIG. 2, the implant body 222 also includes the sound processor 112, and the tinnitus relief system 118, all of which were part of the external component 102 in FIG. 1B. The implant body 222 also includes the implantable coil 136 and one or more implantable microphones 208 that are generally external to the housing 128. Similar to implantable coil 136, the implantable microphones 208 are also connected to the sound processor 112 via a hermetic feedthrough (not shown in FIG. 2). Finally, the implant body 222 comprises a battery 234.

Cochlear implant 200 includes sound input elements in the form of implantable microphones 208 that, possibly in combination with one or more external microphones (not shown in FIG. 2), are configured to detect/receive sound signals and generate electrical input signals therefrom. These input signals are representative of the detected sound signals. The sound processor 112 is configured to execute sound processing and coding to convert the input signals, and/or signals from other sound input elements (not shown in FIG. 2), into data signals. The stimulator unit 132 is configured to utilize the data signals to generate stimulation signals for delivery to the recipient's cochlea via one or stimulating contacts 138, thereby evoking perception of the sound signals detected by the microphones.

The transceiver 130 permits cochlear implant 200 to receive signals from, and/or transmit signals to, an external device 202. The external device 202 can be used to, for example, charge the battery 234. In such examples, the external device 202 may be a dedicated charger or a conventional cochlear implant sound processor. Alternatively, the external device 202 can include one or more microphones or sound input elements configured to generate data for use by the sound processor 112. External device 202 and cochlear implant 200 may be collectively referred to as forming a cochlear implant system.

The examples of FIGS. 1A, 1B, and 2 illustrate that a tinnitus relief system in accordance embodiments of the present invention can be implemented as part of different portions of a hearing prosthesis and in hearing prostheses having different arrangements. However, merely for ease of illustration, further details of the embodiments presented herein will generally be described with reference to arrangements having an external component (e.g., the arrangement shown in FIGS. 1A and 1B).

Figure 3:
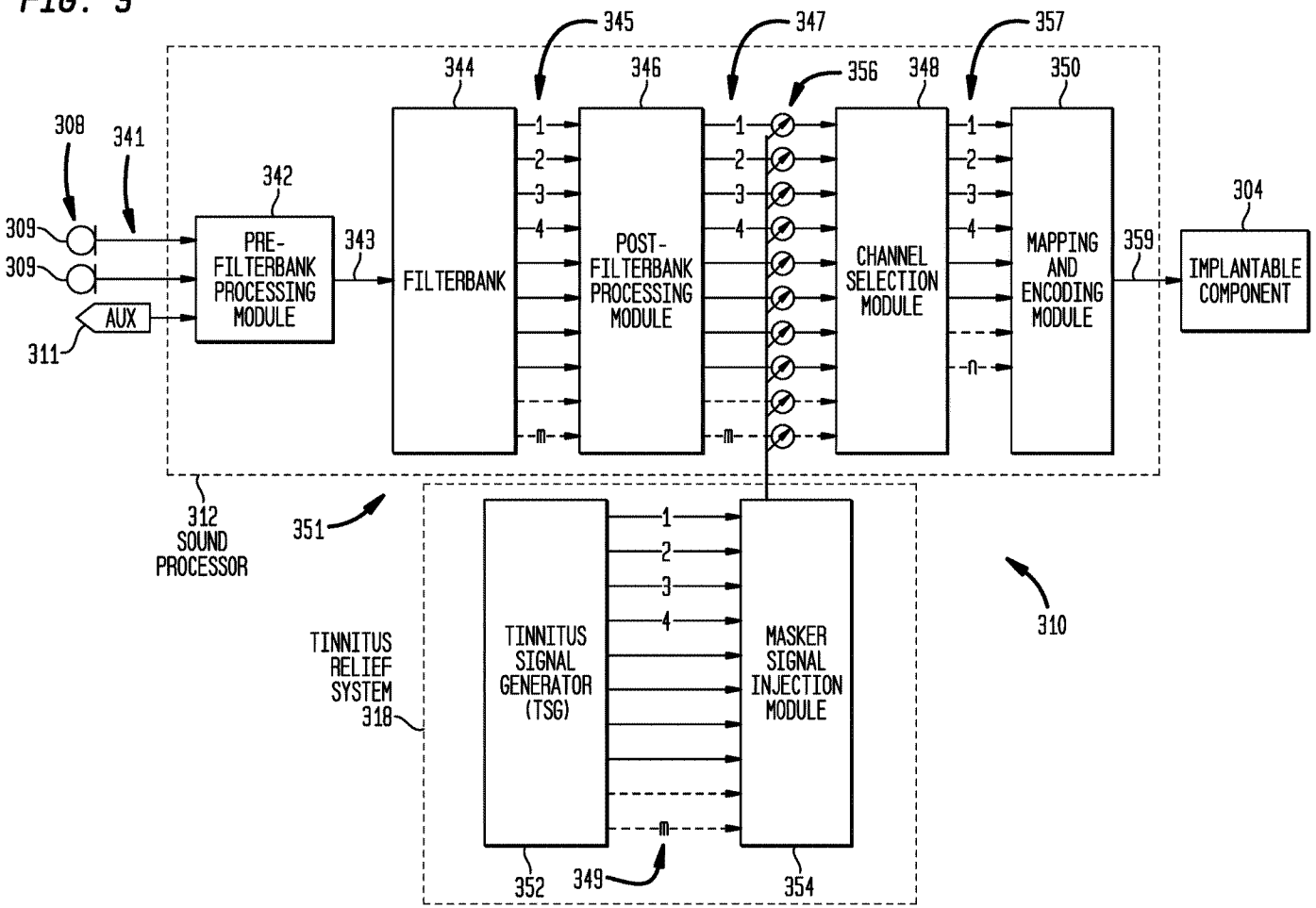
FIG. 3 is a diagram illustrating a sound processing unit that comprises a tinnitus relief system in accordance with embodiments presented herein.

FIG. 3 is a schematic diagram illustrating example arrangements for a sound processor 312 and a tinnitus relief system 318 forming part of a sound processing unit 310 of a cochlear implant in accordance with embodiments presented herein. The sound processor 312 comprises a pre-filterbank processing module 342, a filterbank 344, a post-filterbank processing module 346, a channel selection module 348, and a channel mapping module 350. Collectively, the filterbank 344, the post-filterbank processing module 346, the channel selection module 348, and the channel mapping module 350 form a sound processing path 351 that, as described further below, converts one or more sound signals into one or more output signals for use in compensation of a hearing loss of a recipient of the cochlear implant (i.e., output signals for use in generating electrical stimulation signals for delivery to the recipient as to evoke perception of the received sound signals). That is, as used herein, the sound processing path 351 begins at the filterbank operations performed at filterbank 344 and terminates at the channel mapping operations performed at channel mapping module 350.

As shown, multiple sound input elements 308, such as one or more microphones 309 and one or more auxiliary inputs 311 (e.g., audio input ports, cable ports, telecoils, a wireless transceiver, etc.) receive/detect sound signals which are then provided to the pre-filterbank processing module 342. If not already in an electrical form, sound input elements 308 convert the sound signals into an electrical form for use by the pre-filterbank processing module 342. The arrows 341 present the electrical input signals provided to the pre-filterbank processing module 342.

The pre-filterbank processing module 342 is configured to, as needed, combine the electrical input signals received from the sound input elements 308 and prepare those signals for subsequent processing. The pre-filterbank processing module 342 then generates a pre-filtered input signal 343 that is provided to the filterbank 344. The pre-filtered input signal 343 represents the collective sound signals received at the sound input elements 308 at a given point in time.

The filterbank 344 uses the pre-filtered input signal 343 to generate a suitable set of bandwidth limited channels, or frequency bins, that each includes a spectral component of the received sound signals that are to be utilized for subsequent sound processing. That is, the filterbank 344 is a plurality of band-pass filters that separates the pre-filtered input signal 343 into multiple components, each one carrying a single frequency sub-band of the original signal (i.e., frequency components of the received sounds signal as included in pre-filtered input signal 343).

The channels created by the filterbank 344 are sometimes referred to herein as sound processing channels, and the sound signal components within each of the sound processing channels are sometimes referred to herein in as band-pass filtered signals or channelized signals. As described further below, the band-pass filtered or channelized signals created by the filterbank 344 may be adjusted/modified as they pass through the sound processing path 351. As such, the band-pass filtered or channelized signals are referred to differently at different stages of the sound processing path 351. However, it will be appreciated that reference herein to a band-pass filtered signal or a channelized signal may refer to the spectral component of the received sound signals at any point within the sound processing path 351 (e.g., pre-processed, processed, selected, etc.).

At the output of the filterbank 344, the channelized signals are initially referred to herein as pre-processed signals 345. The number 'm' of channels and pre-processed signals 345 generated by the filterbank 344 may depend on a number of different factors including, but not limited to, implant design, number of active electrodes, coding strategy, and/or recipient preference(s). In certain arrangements, twenty-two (22) channelized signals are created and the sound processor 312 is said to include 22 channels.

In general, the electrical input signals 341 and the pre-filtered input signal 343 are time domain signals (i.e., processing at pre-filterbank processing module 342 occurs in the time domain). However, the filterbank 344 operates to deviate from the time domain and, instead, create a "channel" or "channelized" domain in which further sound processing operations are performed. As used herein, the channel domain refers to a signal domain formed by a plurality of amplitudes at various frequency sub-bands. In certain embodiments, the filterbank 344 passes through the amplitude information, but not the phase information, for each of the 'm' channels. This is often due to one or more of the methods of envelope estimation that might be used in each channel, such as half wave rectification (HWR) or low pass filtering (LPF), Quadrature or Hilbert envelope estimation methods among other techniques. As such, the channelized or band-pass filtered signals are sometimes referred to herein as "phase-free" signals. In other embodiments, both the phase and amplitude information may be retained for subsequent processing.

In embodiments in which the band-pass filtering operations eliminate the phase information (i.e., generate phase-free signals), the channel domain may be viewed as distinguishable from the frequency domain because signals within the channel domain cannot be exactly/precisely converted back to the time domain. That is, due to the removal of the phase information in certain embodiments, the phase-free channelized signals in the channel domain are not exactly convertible back to the time domain.

The sound processor 312 also includes a post-filterbank processing module 346. The post-filterbank processing module 346 is configured to perform a number of sound processing operations on the pre-processed signals 345. These sound processing operations include, for example gain adjustments (e.g., multichannel gain control), noise reduction operations, signal enhancement operations (e.g., speech enhancement), etc., in one or more of the channels. As used herein, noise reduction is refers to processing operations that identify the "noise" (i.e., the "unwanted") components of a signal, and then subsequently reduce the presence of these noise components. Signal enhancement refers to processing operations that identify the "target" signals (e.g., speech, music, etc.) and then subsequently increase the presence of these target signal components. Speech enhancement is a particular type of signal enhancement. After performing the sound processing operations, the post-filterbank processing module 346 outputs a plurality of processed channelized signals 347.

As shown in FIG. 3, the sound processing unit 310 also includes a tinnitus relief system 318 that operates with the sound processor 312. In the embodiment of FIG. 3, the tinnitus relief system 318 comprises a tinnitus signal generator 352 and a masker injection module 354. The tinnitus signal generator 352 is configured to generate a channelized tinnitus masker signal, which is sometimes referred to herein as a channelized tinnitus relief sound. The tinnitus masker signal generated by the tinnitus signal generator 352 is referred to as being "channelized" because it is formed by a plurality of separate/discrete amplitudes at different frequency sub-bands that each correspond to a channel (i.e., a specific frequency sub-band) of the sound processing path 351. In FIG. 3, the channelized tinnitus masker signal, which is represented by arrows 349, may include frequency-limited components or full-band components. Further details regarding the generation of the channelized tinnitus masker signal 349 are provided below.

As noted, the tinnitus relief system 318 also comprises a masker signal injection module 354. The masker signal injection module 354 is configured to inject the channelized tinnitus masker signal into the sound processing channels of the sound processing path 351. That is, one or more components of the channelized tinnitus masker signal 349 are combined with, or otherwise applied to, channelized signals in a corresponding sound processing channel (i.e., the components of the channelized tinnitus masker signal are separately applied/combined with separate channelized signals). As a result, the channelized tinnitus masker signal 349 forms part of the one or more output signals generated by the sound processor 312 for use in compensation of a hearing loss of a recipient of the cochlear implant. The injection of the channelized tinnitus masker signal 349 into the sound processing channels of the sound processing path 351 is generally shown in FIG. 3 at 356.

Injection of the channelized tinnitus masker signal into one or more sound processing channels could occur via a number of mechanisms, including, but not limited to: (1) summation/addition/superposition (unweighted or weighted), (2) gated or rules based selective injection (e.g., injection only occurs if the channel level is above/below some criteria, such as the masker signal level) and/or the post-filterbank processing module output level, (3) random or stochastic injection, etc. The injection of the channelized tinnitus masker signal into one or more of the sound processing channels could also be further controlled by time-based or temporal-based rules, including, but not limited to: (1) simultaneous injection into all or a plurality of channels, (2) round robin or multiplexed selection of channels for injection, (3) random or occasional selection of channels for injection, etc. The channelized tinnitus masker signal may be injected into all of the sound processing channels or a subset of the sound processing channels that are either contiguous or non-contiguous.

In the embodiment of FIG. 3, the masker sound injection module 354 is configured to inject the channelized tinnitus masker signal 349 into the sound processing path 351 between the post-filterbank processing module 346 and the channel selection module 348. In other words, the injection occurs after the noise reduction, signal enhancement, gain adjustment, and other sound processing operations that have the potential to affect the success of the tinnitus relief in some unintended manner, but before a channel selection process. The channel selection process at channel selection module 348 is configured to select, according to one or more selection rules, which of the 'm' processed channelized signals 347, when combined with the channelized tinnitus masker signal 349, should be used for hearing compensation.

In the embodiment of FIG. 3, the channel selection module 348 selects a subset 'n' of the 'm' processed channelized signals 347 and combined channelized tinnitus masker signal 349 for use in generation of stimulation for delivery to a recipient (i.e., the sound processing channels are reduced from 'm' channels to 'n' channels). In one specific example, the 'n' largest amplitude channels (maxima) from the 'm' available combined channel signals/masker signals is made, with 'm' and 'n' being programmable during cochlear implant fitting, and/or operation of the cochlear implant. It is to be appreciated that different channel selection methods could be used, and are not limited to maxima selection. The signals selected at channel selection module 348 are represented in FIG. 3 by arrows 357 and are referred to as selected channelized signals or, more simply, selected signals.

As noted, the processing location 356 at which the channelized tinnitus masker signal 349 in FIG. 3 is injected into the sound processing path 351 after any noise reduction and/or signal enhancement operations are completed at post-filterbank processing module 346, but before channel selection at channel selection module 348. As a result, the channel selection is based on both (i.e., the combination of) the processed channelized signals 347 and the channelized tinnitus masker signal 349.

The sound processor 312 also comprises the channel mapping module 350. The channel mapping module 350 is configured to map the amplitudes of the selected signals 357 into a set of stimulation commands that represent the attributes of stimulation signals (current signals) that are to be delivered to the recipient so as to evoke perception of the received sound signals. This channel mapping may include, for example, threshold and comfort level mapping, dynamic range adjustments (e.g., compression), volume adjustments, etc., and may encompass sequential and/or simultaneous stimulation paradigms.

In the embodiment of FIG. 3, the set of stimulation commands that represent the stimulation signals are encoded for transcutaneous transmission (e.g., via an RF link) to an implantable component 304. This encoding is performed, in the specific example of FIG. 3, at channel mapping module 350. As such, channel mapping module 350 is sometimes referred to herein as a channel mapping and encoding module and operates as an output block configured to convert the plurality of channelized signals into a plurality of output signals 359.

As noted, the filterbank 344, the post-filterbank processing module 346, the channel selection module 348, and the channel mapping module 350 collectively form a sound processing path 351 that converts the one or more received sound signals into one or more output signals for use in compensation of a hearing loss of a recipient of the cochlear implant. In other words, the sound processing path 351 extends from the filterbank 344 to the channel mapping module 350. In FIG. 3, the output signals 359 generated by the sound processor 312 comprise a plurality of encoded signals for delivery to the implantable component 304.

It is to be noted that embodiments presented herein include the ability to create channelized tinnitus masker signals having different numbers of components (e.g., more or less than 22 channels is possible). For example, less than 22 channels are required in the signal path (e.g., when using the CIS coding strategy) and/or less than 22 channels are mapped to electrodes. In other cases, an electrode array with less than 22 electrodes is available, and therefore usually less than 22 channels are present in the signal path (e.g., some electrode arrays may only have 8 or 10 electrodes, resulting in the use of fewer than 22 channels the signal processing path). As a result, 'm' and 'n,' as used to refer to both channels and components of a channelized tinnitus masker signal are configurable and may vary in different embodiments of the present invention.

As noted, FIG. 3 illustrates an embodiment in which the injection point 356 for the channelized tinnitus masker signal 349 is between the post-filterbank processing module 346 and the channel selection module 348. However, it is to be appreciated that a channelized tinnitus masker signal may be injected into other locations/points of the sound processing path 351 subsequent to noise reduction, signal enhancement, gain adjustment, and other sound processing operations that have the potential to affect the success of the tinnitus relief in some unintended manner.

Figure 4:
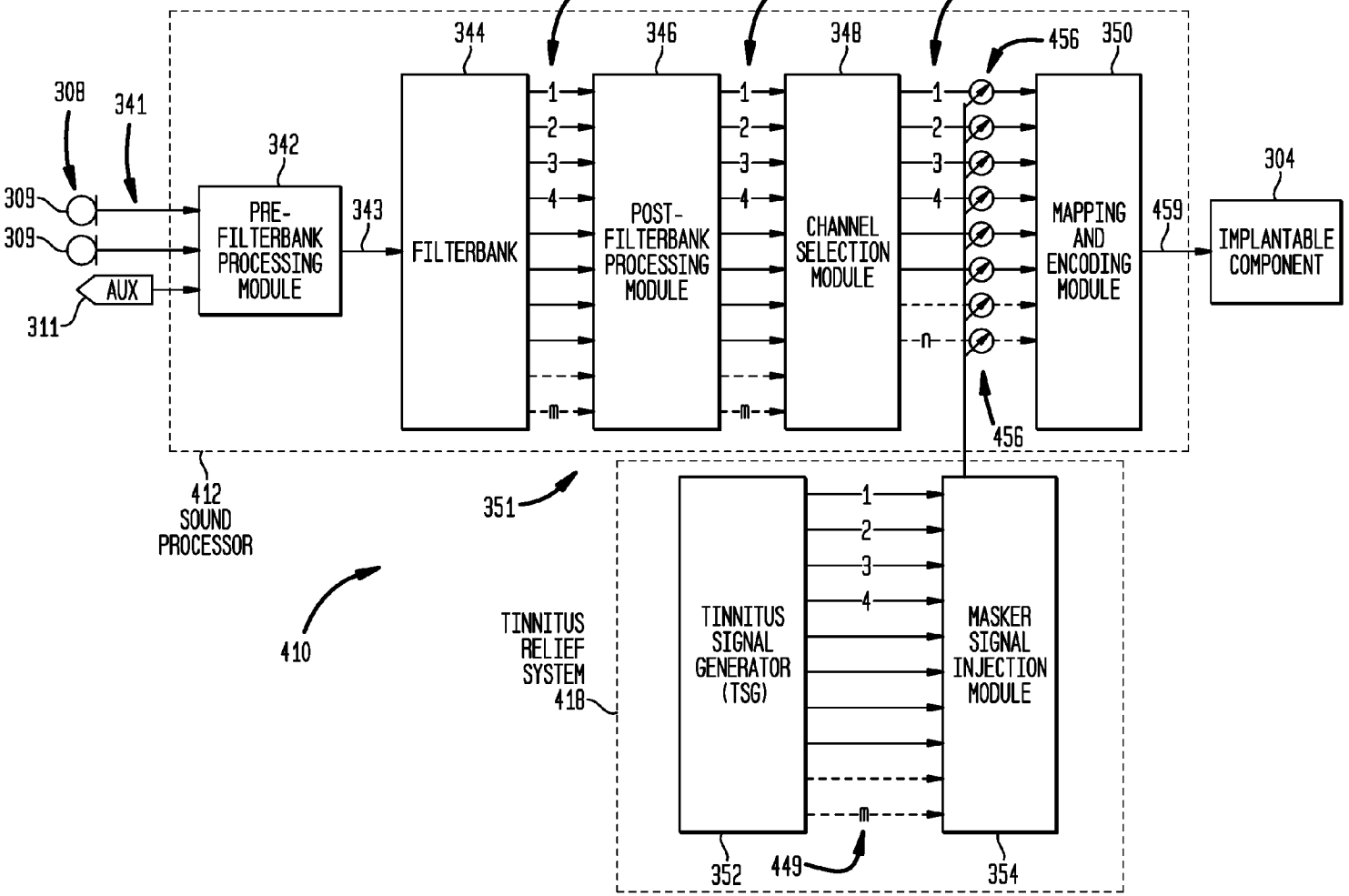
FIG. 4 is a diagram illustrating another sound processing unit that comprises a tinnitus relief system in accordance with embodiments presented herein.

For example, FIG. 4 illustrates an alternative embodiment of a sound processing unit 410 that comprises a sound processor 412 and a tinnitus relief system 418. The sound processor 412 and the tinnitus relief system 418 are substantially similar to the sound processor 312 and the tinnitus relief system 318, respectively, described above with reference to FIG. 3. However, in the embodiment of FIG. 4, the sound processor 412 and tinnitus relief system 418 are operably connected such that the tinnitus masker signal 349 is injected after the channel selection is performed at channel selection 348.

More specifically, in the embodiment of FIG. 4, the channel selection at channel selection module 348 is based only on the plurality of processed channelized signals 347, but not on the channelized tinnitus masker signal. In FIG. 4, the components/channels selected by channel selection module 348 are represented by arrows 457. A channelized tinnitus masker 449 is then applied to one or more of the selected signals 457. The injection of the channelized tinnitus masker signal 449 into sound processing path 351 is generally shown in FIG. 4 at 456.

The channel mapping module 350 is configured to map the amplitudes of the selected signals 457, after combination with the components of the channelized tinnitus masker 449, into a set of output signals 459. The output signals 459 comprise stimulation commands that represent the attributes of stimulation signals that are to be delivered to the recipient.

In the above embodiment of FIG. 3, the channelized tinnitus masker signal 349 may, potentially, be injected into 'm' channels that are present prior to the channel selection. In contrast, in FIG. 4 the channelized tinnitus masker signal 449 may only be injected into the selected 'n' channels. FIG. 4 illustrates an example in which the channelized tinnitus masker signal 449 is generated with 'm' components and in which the masker signal injection module 354 is used to determine which of the 'm' components are injected into the 'n' selected channels. In other embodiments, feedback from the channel selection module 348 to the tinnitus signal generator 352 may enable the channelized tinnitus masker signal 449 to be generated with 'n' components corresponding to the 'n' selected channels.

The embodiment of FIG. 4 has a potential benefit that the channelized tinnitus masker is always presented to the recipient. That is, in contrast to the embodiment of FIG. 3, there is no risk that all or part of the channelized tinnitus masker signal is removed through the channel selection process.

FIGS. 3 and 4 illustrate embodiments in which the sound processors 310 and 410 each include a channel selection module 348 that selects a subset 'n' of the 'm' available channels for use in stimulating a recipient. However, it is to be appreciated that embodiments of the present invention may be used with sound processors that do not perform channel selection.

Figure 5:
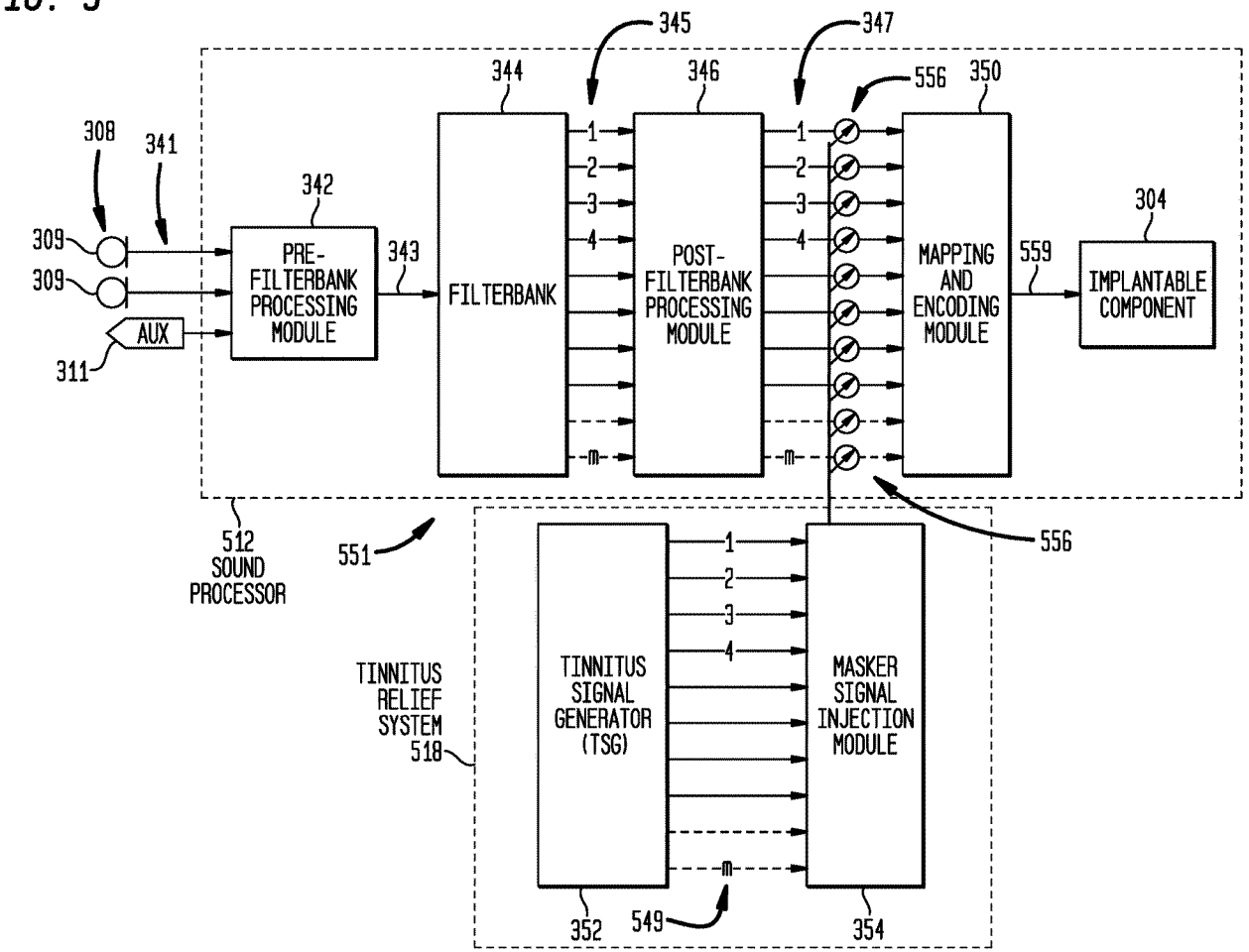
FIG. 5 is a diagram illustrating another sound processing unit that comprises a tinnitus relief system in accordance with embodiments presented herein.

For example, FIG. 5 illustrates an alternative embodiment of a sound processing unit 410 that comprises a sound processor 512 that is similar to sound processor 312 of FIG. 3, except that the sound processor 512 does not include a channel selection module. That is, sound processor 512 includes the pre-filterbank processing block/module 342, the filterbank 344, the post-filterbank processing module 346, and the channel mapping module 350. Collectively, the filterbank 344, the post-filterbank processing module 346, and the channel mapping module 350 form a sound processing path 551 that converts the one or more sound signals into one or more output signals for use in compensation of a hearing loss of a recipient of the cochlear implant. The sound processor 512 illustrates an arrangement that uses a continuous interleaved sampling (CIS), CIS-based, or other non-channel selection sound coding strategy.

In the embodiment of FIG. 5, a channelized tinnitus masker signal 549 is applied to one or more of the processed channelized signals 347 (i.e., the channelized tinnitus masker signal is injected subsequent to noise reduction, signal enhancement, gain adjustment, and other sound processing operations that have the potential to affect the success of the tinnitus relief in some unintended manner). The injection of the channelized tinnitus masker signal 549 into sound processing path 551 is generally shown in FIG. 5 at 556. In this embodiment, all of the 'm' channels have the potential to be sent to the implantable component 304 for stimulation at all times, including the injected masker signal, depending on the coding strategy used.

Figure 6:
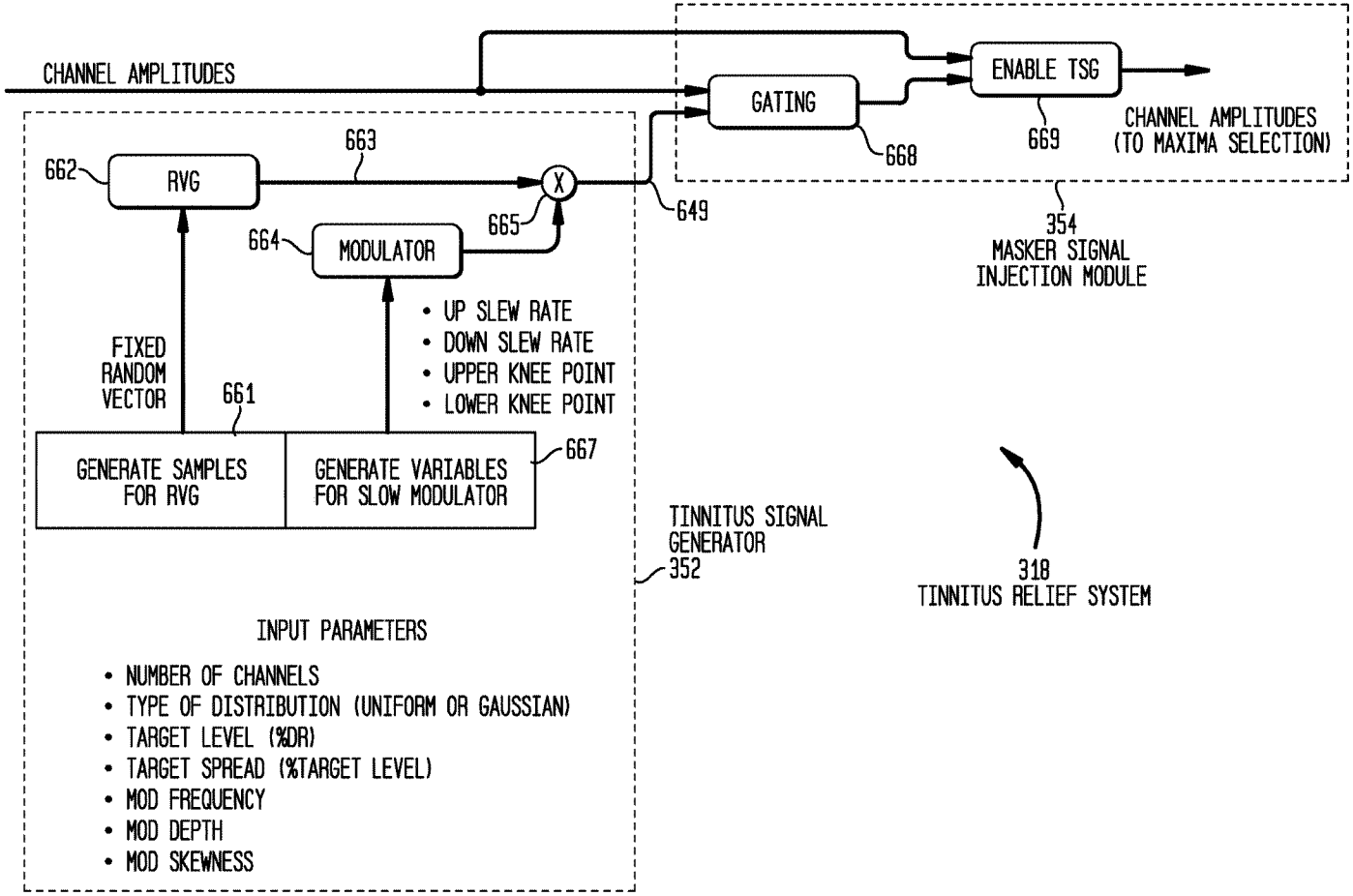
FIG. 6 is a diagram illustrating details of a tinnitus relief system in accordance with embodiments presented herein.

FIG. 6 is a schematic diagram illustrating further details of one arrangement for a tinnitus relief system, such as tinnitus relief system 318, in accordance with embodiments of the present invention. As noted, the tinnitus relief system 318 comprises a tinnitus signal generator 352 and a masker signal injection module 354. In general, the tinnitus signal generator 352 is a sound synthesis engine that creates a tinnitus soothing sound (i.e., the channelized tinnitus masker signal 349) and the masker signal injection module 354 is configured to inject all or a portion of the tinnitus soothing sound into the sound processing path 351 of the sound processor 312 (shown in FIG. 3).

The tinnitus signal generator 352 comprises a random vector generator (RVG) 662 that operates as a sound (e.g., noise) source. The random vector generator 662 generates sounds 663 according to one or more samples 661. The tinnitus signal generator 352 also comprises a modulator 664 that modulates, at 665, the sounds 663 generated by the random vector generator 662. The modulation, which is based on one or more variables 667, is used to create, for example, random (i.e., less constant) sounds or more realistic tinnitus relief sounds, rather than a constant sound (e.g., wave or beach sounds, waterfall sounds, etc.). In certain embodiments, the modulator 664 is configured to at least one of randomly or pseudo-randomly modulate noise samples 661 in order to generate the channelized tinnitus masker signal.

A variety of input parameters may be used to control generation of a channelized tinnitus masker signal (i.e., control operational settings of the tinnitus signal generator 352). These input parameters may be used to control settings related to, for example, the type of sounds (e.g., noise) generated by the tinnitus signal generator, type of sound distributions (e.g., uniform, Gaussian, etc.), levels, modulation type, modulation frequency, channel shaping rules, etc. These settings may, potentially, be set on a per-channel basis (i.e., the sound attributes may be changed and optimized individually per channel). In practice, it is expected that some parameters may be applied unchanged across all channels.

In general, the tinnitus signal generator 352 is aware of the number of sound processing channels present in associated sound processor, as well as the frequency sub-bands that each of those channels cover. As such, the tinnitus signal generator 352 creates an amplitude value for each channel. So, for 22 channels, the tinnitus signal generator 352 creates 22 amplitude samples at any one time, one or more of which can then be injected into the signal path. Stated differently, a channelized tinnitus masker signal generated by a tinnitus signal generator in accordance with embodiments presented herein comprises a series of amplitude components at frequency sub-bands corresponding to the channels of the associated sound processor. In certain examples, the amplitude components are generated without phase information, while in other embodiments the phase information is included. In addition, the frequency sub-bands may not correspond to the channels. For example, in the case where a system has less than 22 channels (e.g., one electrode switched off), it may be undesirable to remap the frequency ranges of all of the 22 channels of the tinnitus masker signal. Therefore, in such embodiments one of the components of the tinnitus masker signal may simply be omitted, and the remaining 21 may be an "approximate" fit to the remaining frequency range. In other words there may not be a direct correspondence between tinnitus masker signal components and the channels and, as such, it is possible to inject non-matched frequency range signals from the tinnitus signal generator 352 into the sound processing channels, even if there is not precise correspondence/matching.

As noted, all or a portion of a channelized tinnitus masker signal 349 may be injected into sound processing channels of the sound processing path 351. Also as noted, the injection of the channelized tinnitus masker signal 349 may be controlled, for example, based on one or more rules (i.e., selective injection). FIG. 6 illustrates a specific embodiment in which selective injection is controlled by a gating function 668. The gating function 668 is configured such that a component of the channelized tinnitus masker signal 349 is only injected on the condition that the component of the tinnitus masker signal is greater than the component/signal present in the corresponding sound processing channel.

More specifically, the gating function 668 performs a comparison of channel amplitudes (i.e., amplitudes of the channelized signals) to the amplitude of a corresponding component of the channelized tinnitus masker signal 349. Only components of the channelized tinnitus masker signal 349 that have amplitudes that are larger than the amplitudes of the channel signals are passed through for injection into the sound processing path 351 (i.e., if the level of the tinnitus masker at each analysis pass is lower than the channel signal at that time, then the channel signal is passed through without addition of the masker signal). The enable function 669 operates as an on/off control for the injection of the channelized tinnitus masker signal 349.

The random vector generator 662 may generate a number of different types of sounds 663 for use in tinnitus relief. For example, the random vector generator 662 may generate white noise, pink noise, etc. Each of these different types of noise has one or more defining characteristics. For example, white noise refers to noise having an equal energy per frequency, while pink noise refers to noise having a 6 decibel (dB) per octave roll off. In one example, the random vector generator 662 generates a specific type of noise which has equal energy per sound processing channel, referred to herein as "yellow noise," and, accordingly, the corresponding channelized tinnitus masker signal as an equal energy per sound processing channel. That is, in embodiments utilizing yellow noise, for every sound processing channel, whether it contains a wide frequency range (e.g., in higher frequencies) or a narrow frequency range (e.g., in low frequencies), the tinnitus masker signal energy is equal per channel (i.e., same average energy per channel at which the masker is applied). An advantage of yellow noise is that it is independent of the number of channels or the frequency boundaries of those channels, or any other channel characteristics.

As noted, FIG. 6 illustrates one specific arrangement for a tinnitus relief system in accordance with embodiments of the present invention. It is to be appreciated that tinnitus relief systems in accordance embodiments presented herein may have different arrangements. For example, FIG. 7 illustrates a tinnitus relief system that is configured to perform channel shaping operations of a channelized tinnitus masker signal before injection of the channelized tinnitus masker signal into the sound processing path.

Figure 7:
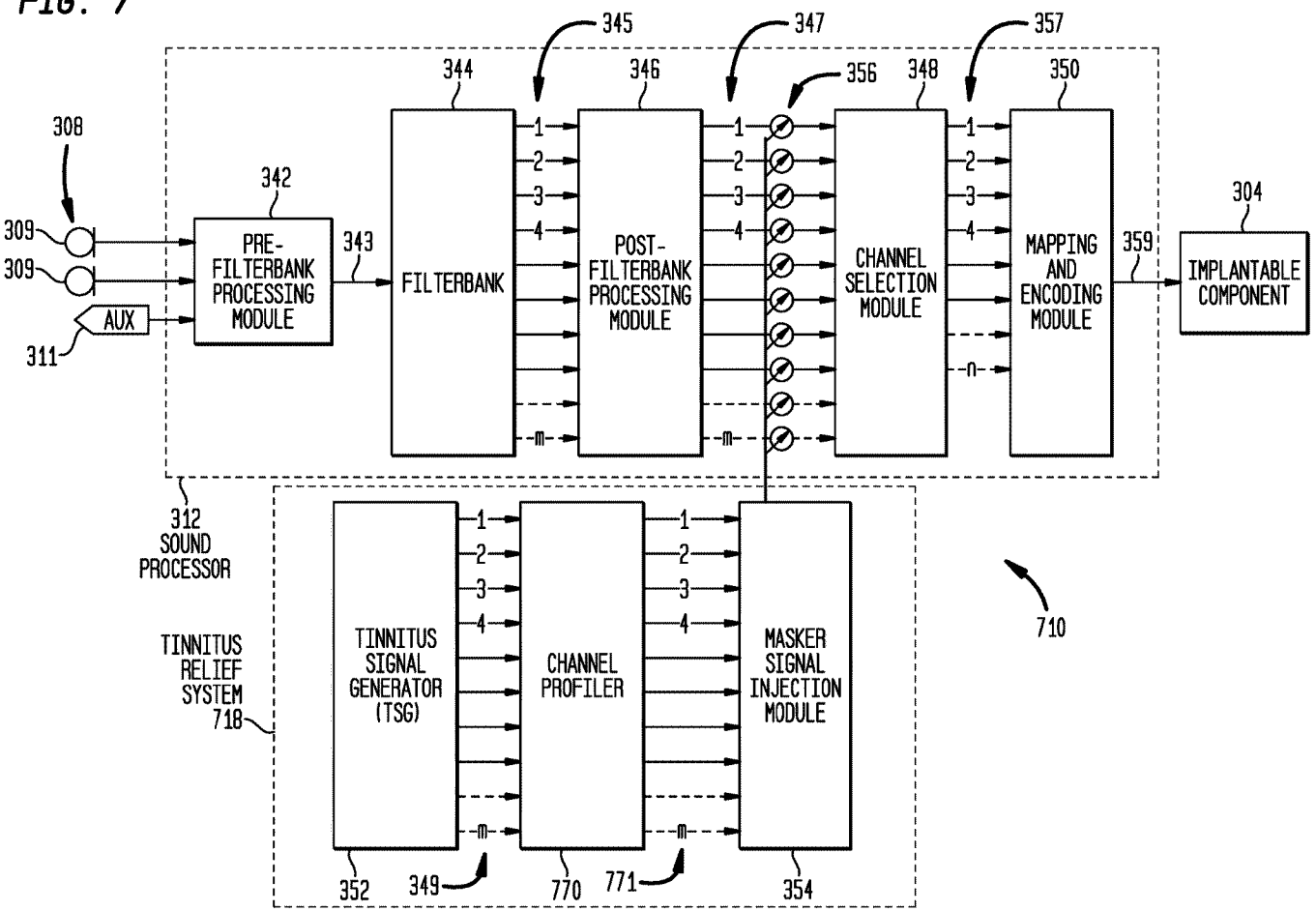
FIG. 7 is a diagram illustrating another sound processing unit that comprises a tinnitus relief system in accordance with embodiments presented herein.

More specifically, FIG. 7 illustrates a sound processing unit 710 that includes the sound processor 310, as described above with reference to FIG. 3, and a tinnitus relief system 718. The tinnitus relief system 718 comprises the tinnitus signal generator 352 and the masker signal injection module 354, also as described above with reference to FIG. 3. However, as shown, the tinnitus relief system 718 also comprises a channel profiler 770.

In the embodiment of FIG. 7, the channel profiler 770, which is sometimes referred to herein as a channel shaping module, is configured to "shape" or adjust the channelized tinnitus masker signal 349 before it is injected into the sound processing path 351. That is, the channel profiler 770 is configured to modify the channelized tinnitus masker signal 349 in accordance with one or more rules so as to control how the characteristics of the masker signal are injected into each channel. For example, the channel profiler 770 may operate to restrict the injection to a sub-set of channels, or to set the "profile" of each channel as a set, again according to some rule(s).

In general, the channel profiler 770 applies a set of rules to suitably adjust the masker so as to best match the needs of the recipient. As shown in FIG. 7, the channel profiler 770 generates a shaped channelized tinnitus masker signal 771, sometimes referred to herein as a shaped tinnitus masker signal, that is injected into the sound processing path 351 at processing location 356 (i.e., between the post-filterbank processing and the channel selection).

In certain arrangement, a tinnitus masking signal may mask a recipient's tinnitus, but it may also be noticeable and/or bothersome to the recipient. The channel shaping provided by channel profile 770 may be advantageous so as to ensure that the tinnitus masking sound achieves the tinnitus masking, but does so in manner that is not, for example, too distracting for the recipient.

Channel profiler 770 is shown separate from tinnitus signal generator merely to facilitate description and understanding of the present invention. It is to be appreciated that the channel shaping functionality of the channel profiler 770 may be incorporated within the tinnitus signal generator 352. For example, it is possible that the channel shaping may be performed before the modulation operations described elsewhere herein.

Figure 8A:
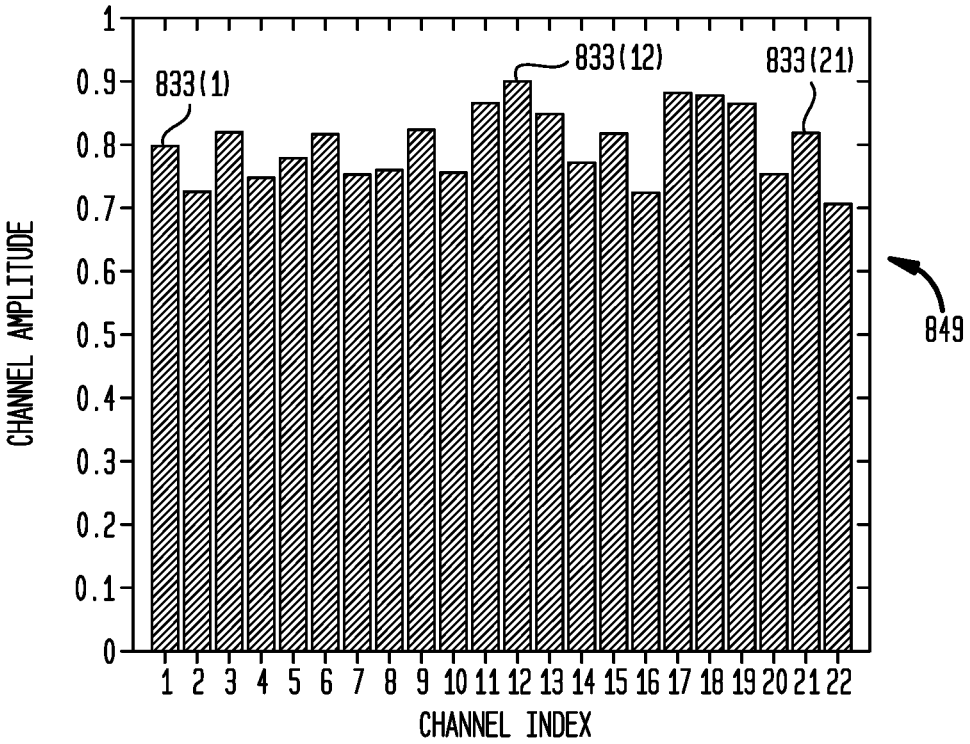
FIG. 8A illustrates a channelized tinnitus masker signal in accordance with embodiments presented herein.

FIGS. 8A-8B, 9A-9B, 10A-10B, and 11A-11B are diagrams illustrating how a channel profiler, such as channel profiler 770, may shape (adjust) a channelized tinnitus masker signal so as to best match the needs of the recipient. Referring first to FIG. 8A, shown is a channelized tinnitus masker signal 849 that, as noted, comprises a plurality of components. In this example, the channelized tinnitus masker signal 849 comprises twenty-two (22) discrete masker components, shown as components 833(1)-833(22), that each correspond to one of the 22 processing channels within the sound processing path 351. Also as noted above, each of the masker components 833(1)-833(22) has an associated amplitude value representing the amplitude of the masker that is generated for the corresponding processing channel. FIG. 8A also illustrates a specific arrangement in which the channelized tinnitus masker signal 849 is a yellow noise signal. However, it is to be appreciated that channel shaping may be applied to other types of channelized tinnitus masker signals.

It is to be appreciated that FIG. 8A illustrates to a single frame of a yellow noise output where the per-channel amplitudes are not shown precisely flat. That is, in yellow noise, the average energy is substantially equal per channel over time, even though the energy may vary from frame to frame. That is, the yellow noise varies from moment to moment, but on average will have the substantially equal energy per channel.

Figure 8B:
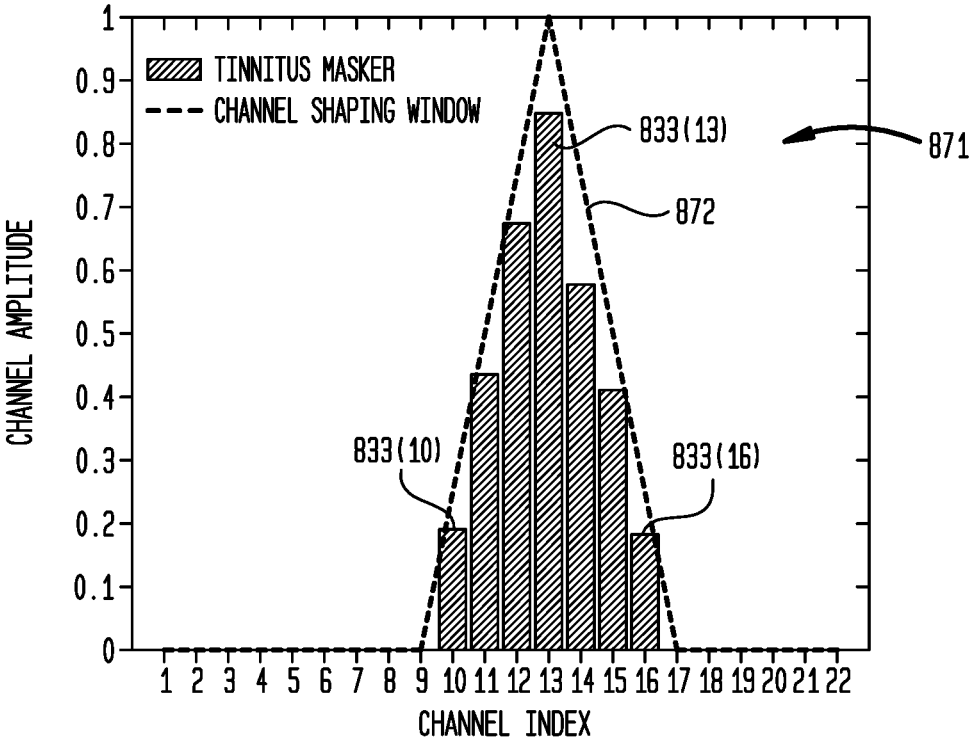
FIG. 8B schematically illustrates application of channel shaping to the channelized tinnitus masker signal of FIG. 8A.

FIG. 8B schematically illustrates a channel shaping window 872 (i.e., one or more channel shaping rules) applied to the channelized tinnitus masker signal 849. In this example, the channel shaping window 872 is a triangular-shaped window centered at sound processing channel 13 (i.e., centered at masker component 833(13)). The channel shaping window 872 adjusts the amplitudes of the masker components that fall within the window to conform to the triangular shape and cancels/eliminates masker components that fall outside of the shaping window. The result is a shaped tinnitus masker signal 871 that has component amplitudes following the profile/shape of the channel shaping window 872 and that are injected only one a subset of the sound processing channels corresponding to the channel shaping window 872 (i.e., only masker components 833 (10)-833(16) are applied at the respective sound processing channels).

The triangular shaping window 872 of FIG. 8B schematically illustrates application of one or more rules to a channelized tinnitus masker signal in or achieve a desired shape/profile for the channelized tinnitus masker signal. It is to be appreciated that other rules could be applied to a channelized tinnitus masker signal in accordance with embodiments of the present invention and that that these rules may be schematically illustrated by different shapes.

Figure 9A:
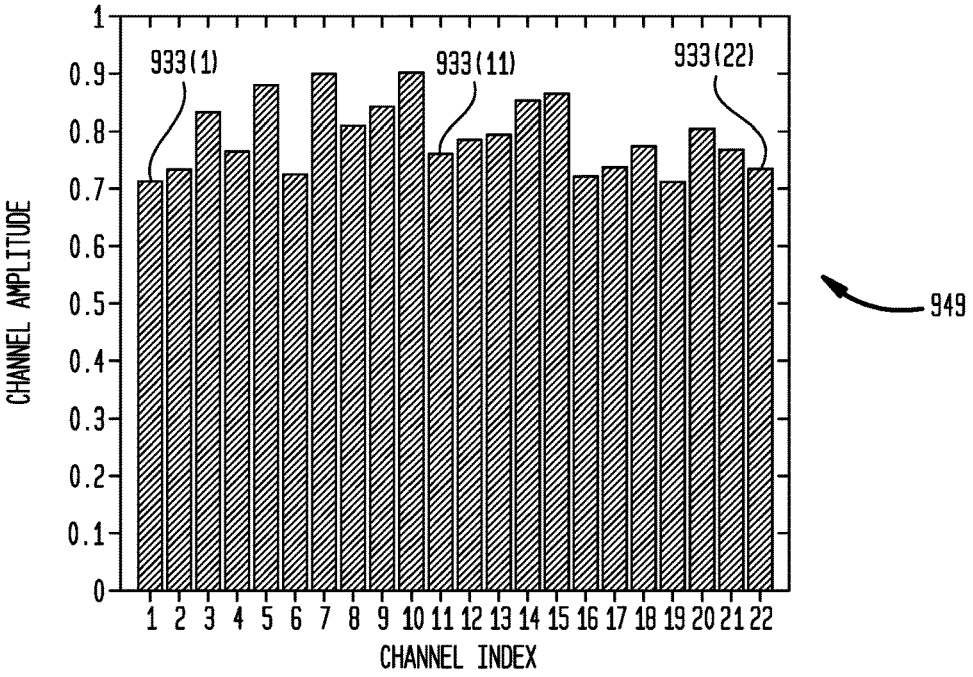
FIG. 9A illustrates a channelized tinnitus masker signal in accordance with embodiments presented herein.
Figure 9B:
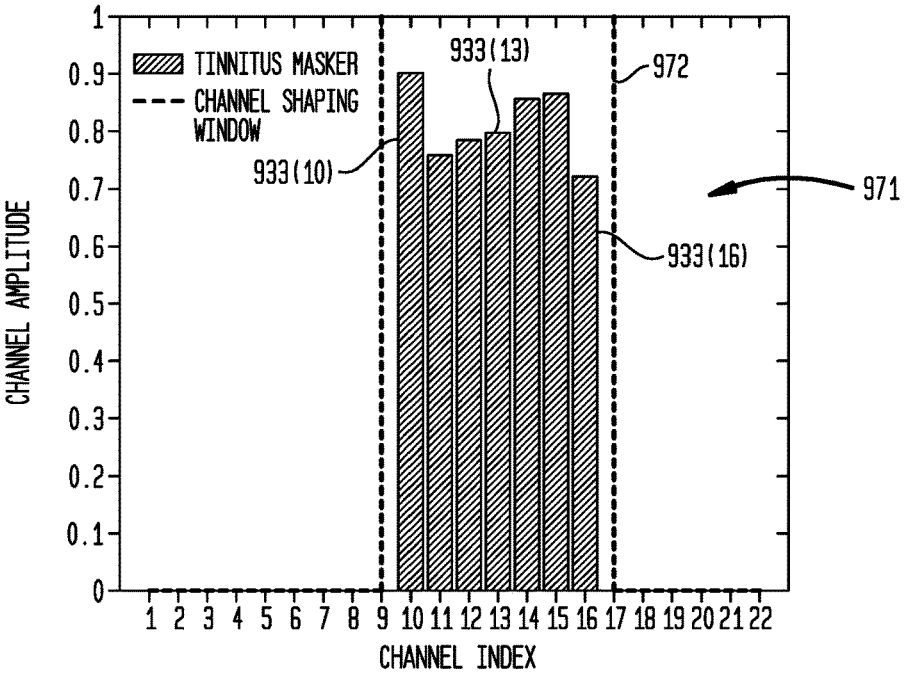
FIG. 9B schematically illustrates application of channel shaping to the channelized tinnitus masker signal of FIG. 9A.

For example, FIG. 9A illustrates a channelized tinnitus masker signal 949 that comprises 22 discrete components 933(1)-933(22) that each has an associated amplitude value representing the amplitude of the masker that is generated for the corresponding processing channel. FIG. 9B schematically illustrates a channel shaping window 972 (i.e., one or more channel shaping rules) applied to the channelized tinnitus masker signal 949. In this example, the channel shaping window 972 is a band-pass shaping window centered at processing channel 13 (i.e., centered at masker component 933(13)). The channel shaping window 972 does not adjust the amplitudes of the masker components that fall within the window, but cancels/eliminates masker components that fall outside of the shaping window. The result is a shaped tinnitus masker signal 971 that is injected at only a subset of the sound processing channels (i.e., only masker components 933(10)-933(16) are applied at the respective sound processing channels 10-16).

Figure 10A:
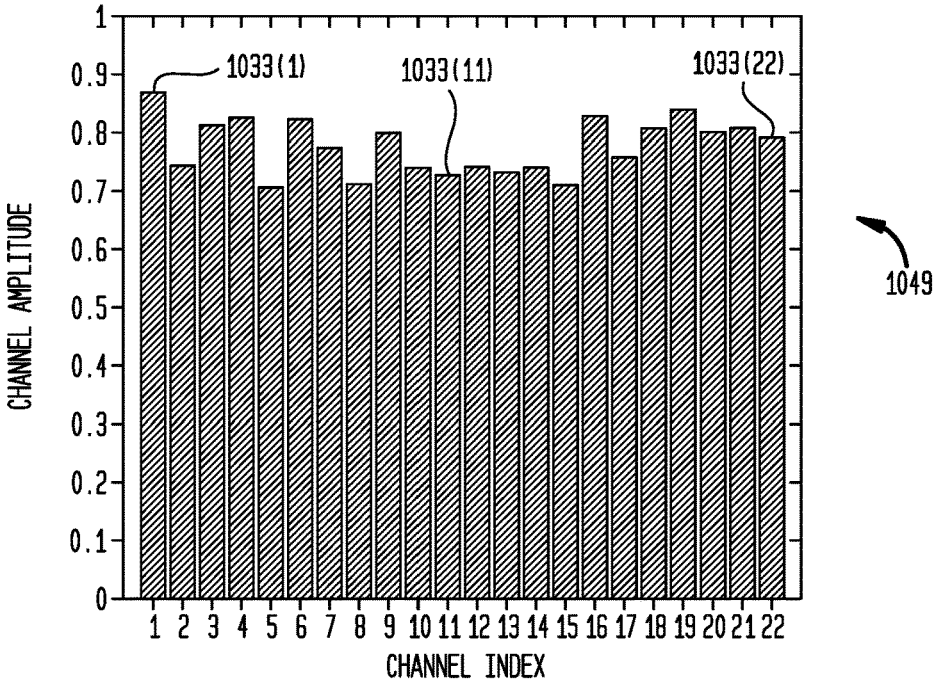
FIG. 10A illustrates a channelized tinnitus masker signal in accordance with embodiments presented herein.
Figure 10B:
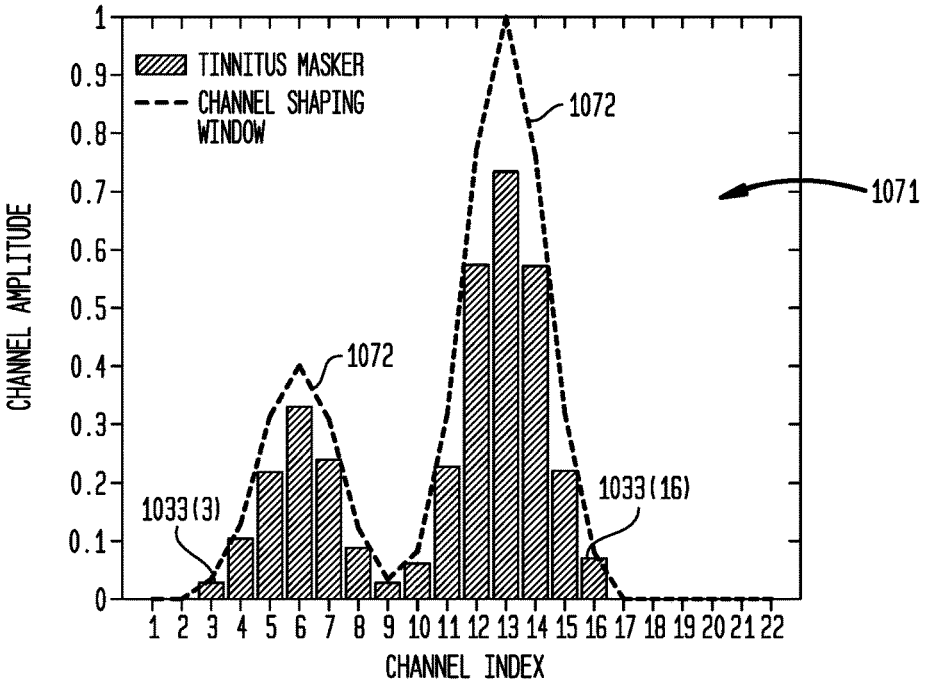
FIG. 10B schematically illustrates application of channel shaping to the channelized tinnitus masker signal of FIG. 10A.

FIG. 10A illustrates another channelized tinnitus masker signal 1049 that comprises 22 discrete components 1033(1)-1033(22) that each has an associated amplitude value representing the amplitude of the masker that is generated for the corresponding processing channel. FIG. 10B schematically illustrates a channel shaping window 1072 (i.e., one or more channel shaping rules) applied to the channelized tinnitus masker signal 1049. In this example, the channel shaping window 1072 is a sinusoidal shaping window centered at processing channels 9 and 10 (i.e., centered at masker components 1033(9) and 1033(10)). The channel shaping window 1072 adjusts the amplitudes of the masker components that fall within the window to conform to the sinusoidal shape and cancels/eliminates masker components that fall outside of the shaping window. The result is a shaped tinnitus masker signal 1071 that is injected on only a subset of the sound processing channels (i.e., only masker components 1033(3)-1033(16) are applied at the respective sound processing channels 3-16).

Figure 11A:
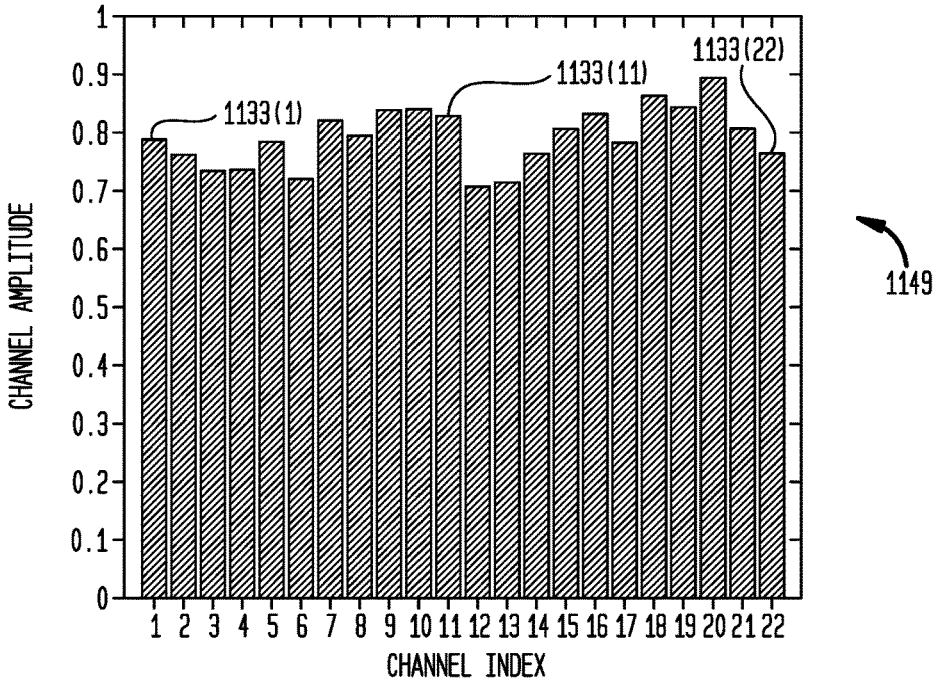
FIG. 11A illustrates a channelized tinnitus masker signal in accordance with embodiments presented herein.
Figure 11B:
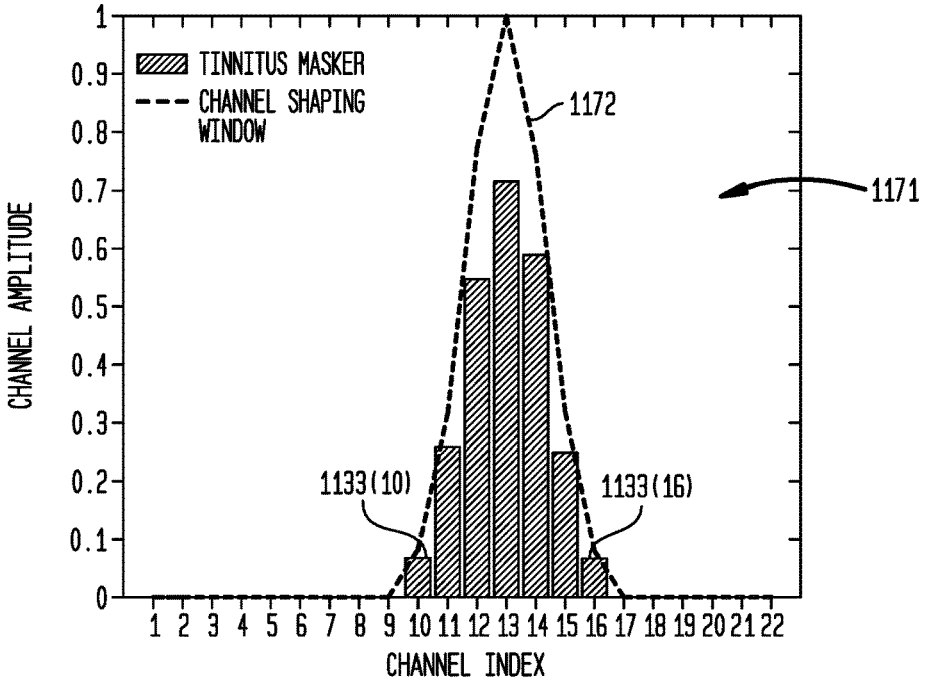
FIG. 11B schematically illustrates application of channel shaping to the channelized tinnitus masker signal of FIG. 11A.

FIG. 11A illustrates another channelized tinnitus masker signal 1149 that comprises 22 discrete components 1133(1)-1133(22) that each has an associated amplitude value representing the amplitude of the masker that is generated for the corresponding processing channel. FIG. 11B schematically illustrates a channel shaping window 1172 (i.e., one or more channel shaping rules) applied to the channelized tinnitus masker signal 1149. In this example, the channel shaping window 1172 is a bell-shaped window centered at processing channel 13 (i.e., centered at masker component 1133(13)). The channel shaping window 1172 adjusts the amplitudes of the masker components that fall within the window to conform to the bell shape and cancels/eliminates masker components that fall outside of the shaping window. The result is a shaped tinnitus masker signal 1171 that is injected at only a subset of the sound processing channels (i.e., only masker components 1133(10)-1133(16) are applied at the respective sound processing channels 10-16).

It is to be appreciated the channel shaping windows shown in FIGS. 8B, 9B, 10B, and 11B are merely illustrative and that other shaping rules may be applied in further embodiments.

Figure 12:
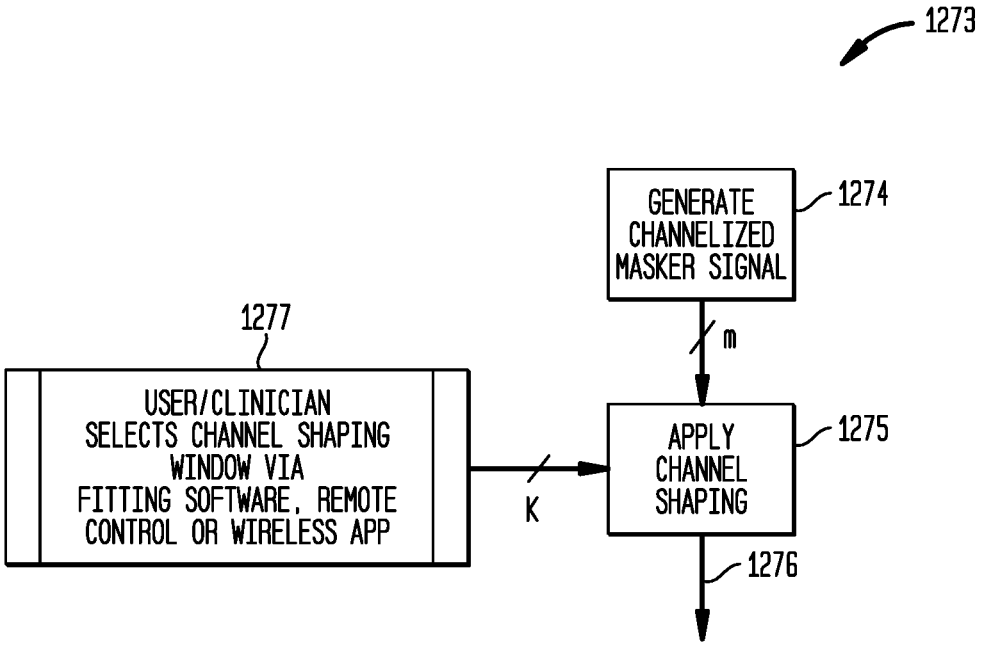
FIG. 12 is a flowchart illustrating channel shaping in accordance with embodiments presented herein.

FIG. 12 is a flowchart illustrating a method 1273 for channel shaping in accordance with embodiments presented herein. Method 1273 begins at 1274 where a tinnitus signal generator generates a channelized tinnitus masker signal having a plurality of components (e.g., 'm' components). At 1275, channel shaping is applied to generate a shaped tinnitus masker signal 1276. The channel shaping (i.e., the adjustment rule(s), such as the number of components (k), the amplitude adjustments, etc.) is selected/set at 1277 by a clinician or other user via, for example, fitting software, a remote control, wireless application (app), etc.

Figure 13:
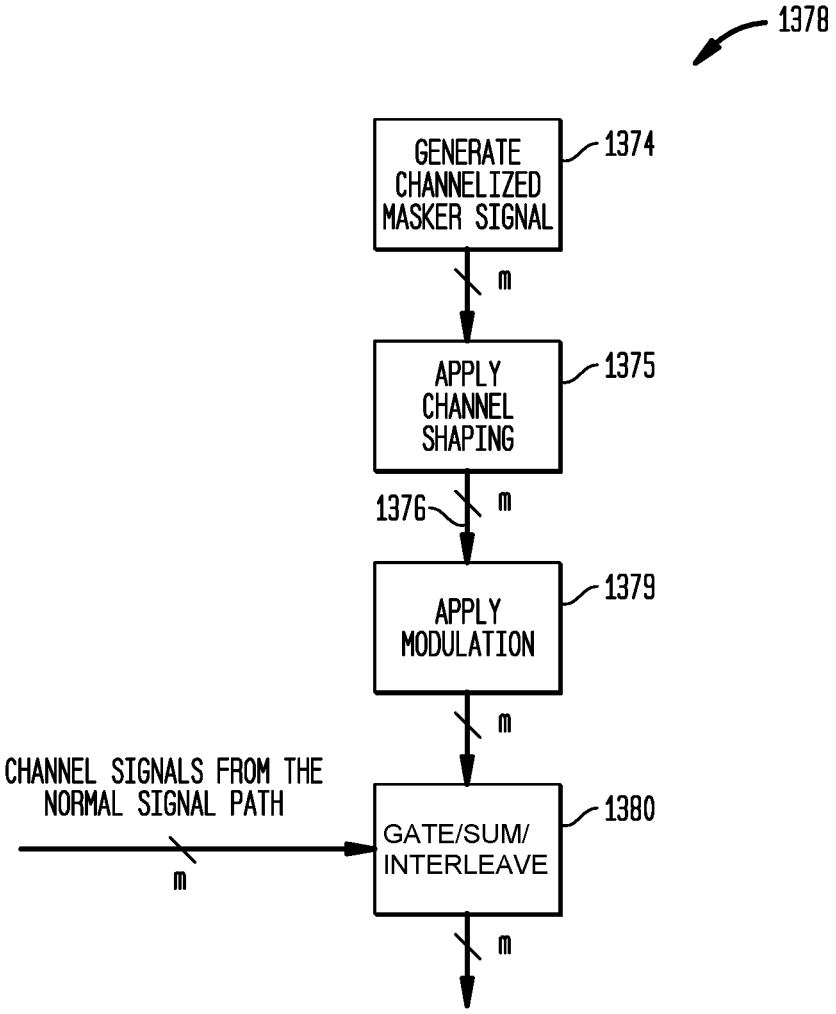
FIG. 13 is a flowchart illustrating channel shaping and selective tinnitus injection in accordance with embodiments presented herein.

FIG. 13 is a flowchart illustrating a method 1378 that combines channel shaping as described with reference to FIGS. 7-12 with selective (e.g., rule-based) masker injection as described with reference to FIG. 6. Method 1378 begins at 1774 where a tinnitus signal generator generates a channelized tinnitus masker signal having a plurality of components (e.g., 'm' components). At 1375, channel shaping is applied to generate a shaped tinnitus masker signal 1376. At 1379, modulation is applied to modulate the shaped tinnitus masker signal 1376 in some manner, as described above (e.g., modulation is applied to all channels in the same way (synchronized), independently to channels, or a combination thereof). At 1380, selective injection is then applied to control injection of the components of the shaped tinnitus masker signal 1376 into sound processing channels.

Figure 14:
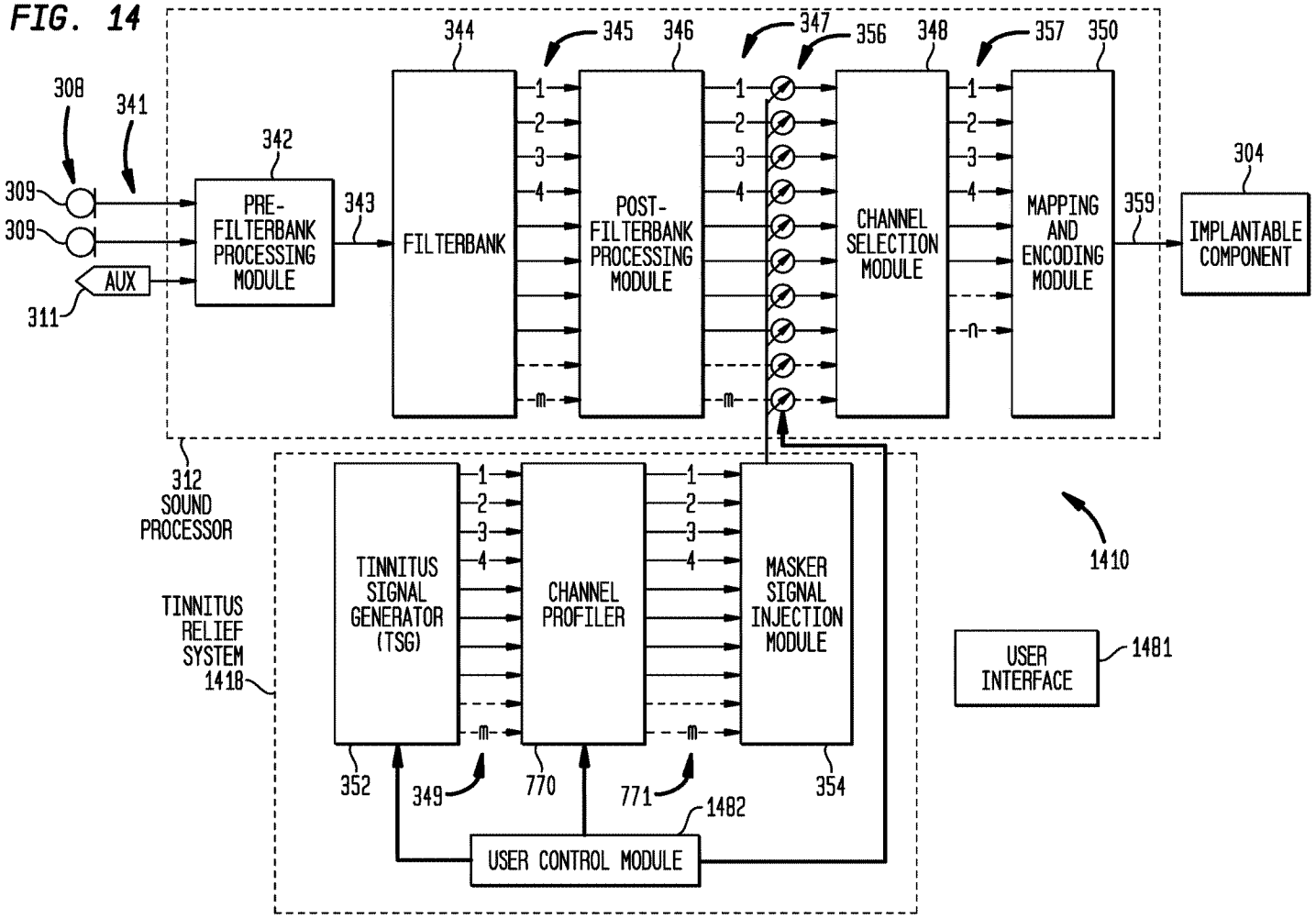
FIG. 14 is a diagram illustrating another sound processing unit that comprises a tinnitus relief system in accordance with embodiments presented herein.

As described above, tinnitus relief systems in accordance with embodiments of the present invention may operate based on various input parameters. These input parameters may include settings related to, for example, the type of sounds (e.g., noise) generated by the tinnitus signal generator, type of sound distributions (e.g., uniform, Gaussian, etc.), levels, modulation type, modulation frequency, channel shaping rules, etc. Tinnitus can only be perceived by the recipient, and, as such, the tinnitus relief that is most effective for a recipient is a highly personal preference. Therefore, it may be advantageous for a tinnitus relief system to allow a recipient or other user to control, potentially in real-time, the various input parameters so as to adapt the tinnitus relief to the recipient's personal preferences. FIG. 14 is a schematic diagram illustrating such an embodiment.

More specifically, FIG. 14 illustrates a sound processing unit 1410 that comprises a tinnitus relief system 1418 and the sound processor 312. The tinnitus relief system 1418 is similar to tinnitus relief system 718 of FIG. 7 and comprises the tinnitus signal generator 352, the channel profiler 770, and the masker injection module 354. However, the tinnitus relief system 1418 also comprises a user control module 1382. The user control module 1482 is configured to enable one or more of clinician, recipient, caregiver, or other user control of some or all of the various parameters that control operation of the tinnitus relief system. In one embodiment, the user control module 1482 is configured to receive the parameters from, for example, an on-board user interface 1481. However, the user control module 1482 may also or alternatively include or interface with a wireless transceiver to wireless receive parameters from a remote control unit, smartphone, etc.

Figure 15:
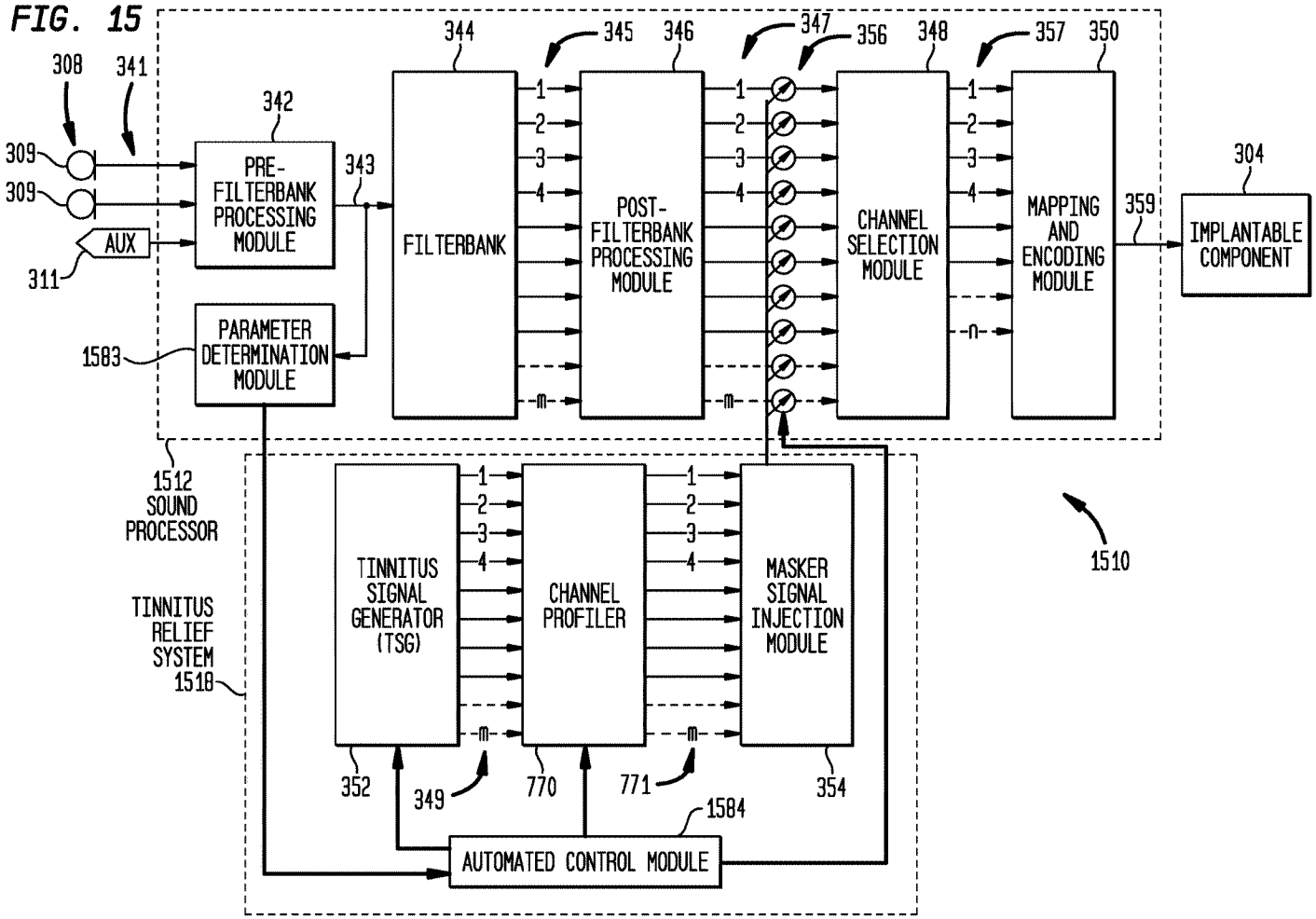
FIG. 15 is a diagram illustrating another sound processing unit that comprises a tinnitus relief system in accordance with embodiments presented herein.

While FIG. 14 illustrates real-time control of the various tinnitus relief system operational parameters, FIG. 15 illustrates an embodiment with automated control of these input parameters. More specifically, FIG. 15 illustrates a sound processing unit 1510 that comprises a tinnitus relief system 1518 and a sound processor 1512. The sound processor 1512 is substantially similar to sound processor 312, but further includes a parameter determination module 1583.

The tinnitus relief system 1518 is similar to tinnitus relief system 718 of FIG. 7 and comprises the tinnitus signal generator 352, the channel profiler 770, and the masker injection module 354. However, the tinnitus relief system 1518 also comprises an automated control module 1584. In the embodiment of FIG. 15, the automated control module 1584 operates to control the various tinnitus relief system operational parameters based on informational inputs received from the parameter determination module 1583. These informational inputs may include, for example, the input sound pressure level of the received sound signals, an environment classification (e.g., noise, speech-in-noise, quiet, etc.), a voice activity level, etc. For example, in one embodiment, the automated control module 1584 uses a classification of the ambient acoustic sound environment (as determined by the parameter determination module 1583) to adjust operation of the tinnitus relief system.

Figure 16:
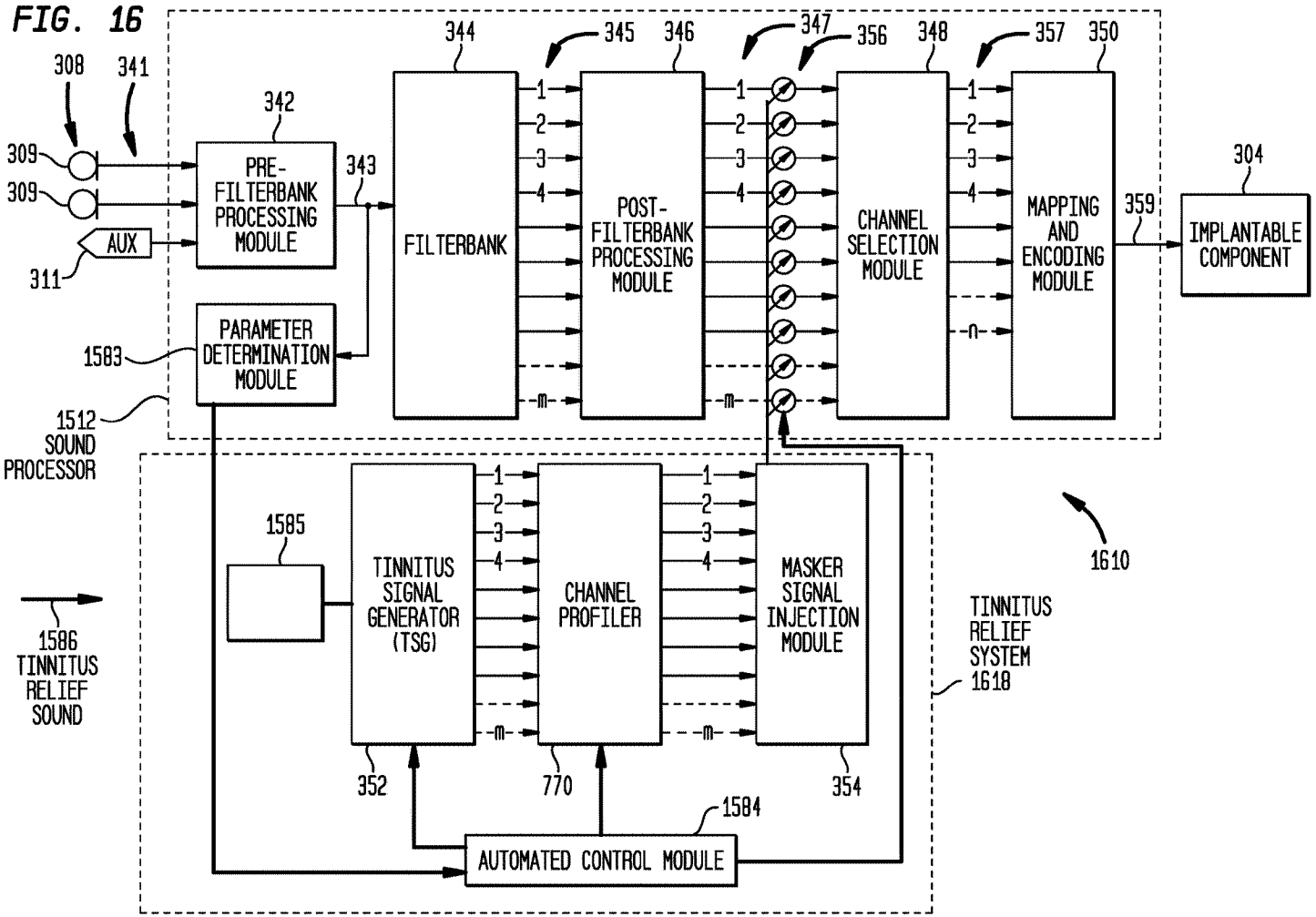
FIG. 16 is a diagram illustrating details of a tinnitus relief system in accordance with embodiments presented herein.

The above embodiments have been primarily described with reference to the generation of noises or other sounds for use in tinnitus relief by an on-board tinnitus signal generator. FIG. 16 illustrates a further embodiment of the present invention that is configured to receive externally generated tinnitus relief sounds and use those externally generated sound to generate channelized tinnitus masker signals for injection into one or more sound processing channels.

More specifically, FIG. 16 illustrates a sound processing unit 1710 that comprises sound processor 1512 as described above with reference to FIG. 15, and a tinnitus relief system 1618. The tinnitus relief system 1618 is similar to tinnitus relief system 1518 of FIG. 15, but also comprises a device interface 1585. The device interface 1585 is configured to receive, via a wired or wireless link, an externally generated tinnitus relief sound 1586, either in single channel or multiple-channel form. In this embodiment, the tinnitus signal generator 352 is configured to convert or otherwise transform the received tinnitus relief sound 1586 into a channelized tinnitus masker signal that is suitable for injection into one or more sound processing channels.

As noted, the device interface 1585 is configured to receive the tinnitus relief sound 1586 via a wired or wireless link. As such, the interface 1585 may comprise, or be connected to, a physical input port (e.g., an auxiliary input 311) or a wireless transceiver. When a tinnitus relief sound 1586 is received from an external source, the sound processing unit 1610 may be configured to enter a special operational mode so that the received tinnitus relief sound 1586 is provided to the tinnitus signal generator 352, and not the sound processing path 351.

The above embodiments have been described with reference to cochlear implants. However, it is to be appreciated that embodiments of the present invention may also be implemented in other hearing prostheses. For example, FIG. 17 is a schematic diagram illustrating a sound processing unit 1710 in accordance with embodiments of the present invention for use in an electro-acoustic hearing prosthesis.

An electro-acoustic hearing prosthesis delivers deliver both acoustic stimulation (i.e., acoustic stimulation signals) and electrical stimulation (i.e., electrical stimulation signals) to a recipient. Acoustic stimulation combined with electrical stimulation is sometimes referred to herein as electro-acoustic stimulation. As such, the sound processing unit 1710 includes an electro-acoustic sound processor 1712 that is generally configured to execute sound processing and coding to convert the sound signals received via sound input elements into coded data signals that represent acoustic and/or electrical stimulation for delivery to the recipient. This is shown in FIG. 17 where the sound processor 1712 includes a sound processing path having two parallel segments/portions, shown as sound processing path segments 1751(A) and 1751(B), where the segment 1751(A) is a cochlear implant sound processing path and the segment 1751(B) is a hearing aid sound processing path.

Figure 17:
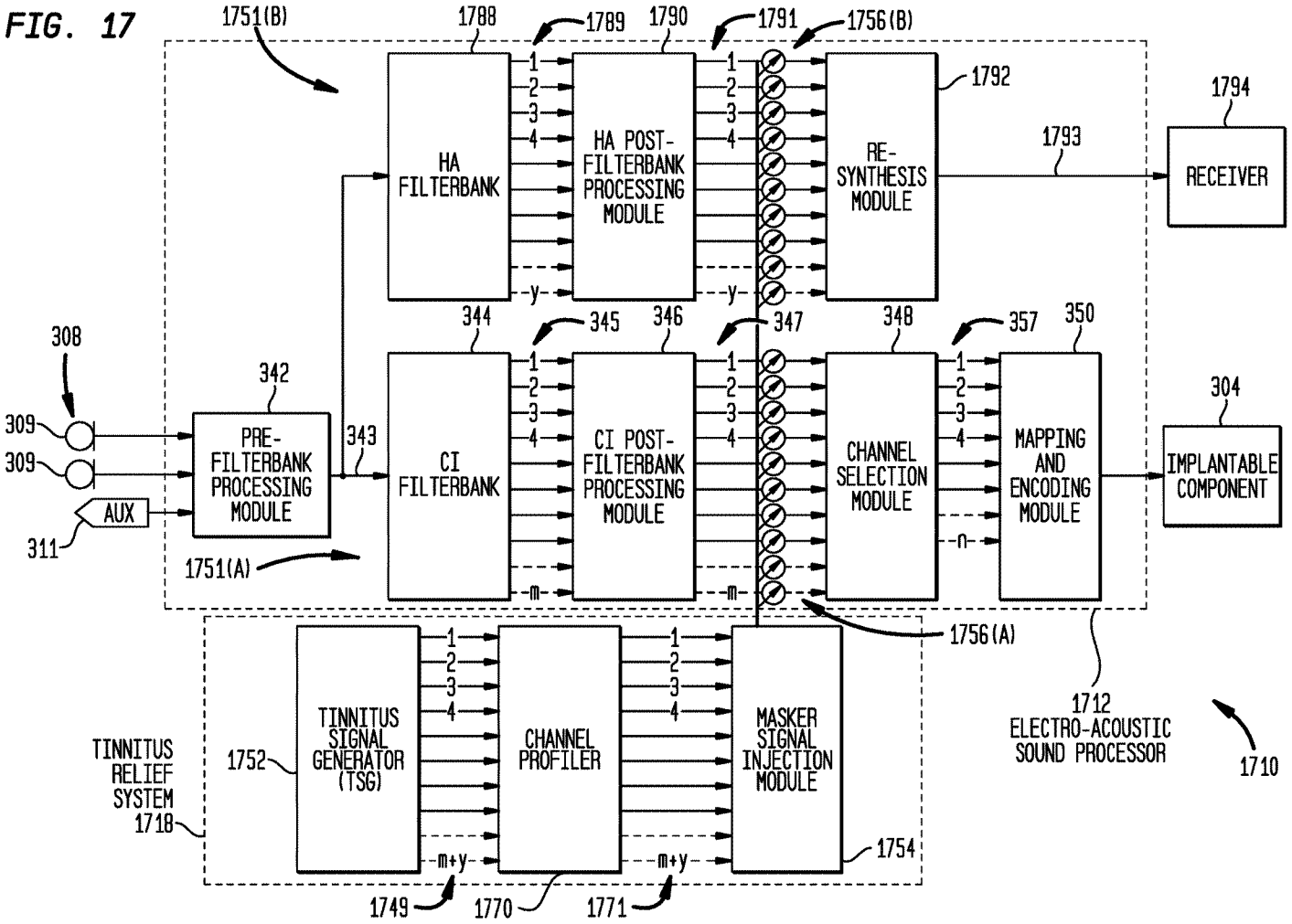
FIG. 17 is a diagram illustrating another sound processing unit that comprises a tinnitus relief system in accordance with embodiments presented herein.

FIG. 17 illustrates that the sound processing unit 1710 comprises sound input elements 308 that provide electrical input signals 341 to a pre-filterbank processing module 342. Segment 1751(A) (i.e., cochlear implant sound processing path) comprises a pre-filterbank processing module 342, a filterbank 344, a post-filterbank processing module 346, a channel selection module 348, and a channel mapping module 350, the operations of which have been described above.

The segment 1751(B) (i.e., hearing aid sound processing path) comprises a filterbank 1788, a post-filterbank processing module 1790, and a re-synthesis module 1792. Due to the presence of the parallel path segments, for ease of illustration and description, the elements of the sound processing path segment 1751(A) are shown and sometimes referred to using the prefix "cochlear implant (CI)," while the elements of the sound processing path segment 1751(B) are shown and sometimes referred to using the prefix "hearing aid (HA)."

In FIG. 17, the pre-filterbank processing module 342 generates a pre-filtered input signal 343 that is provided to both the CI filterbank 344 and the HA filterbank 1788. Again, operation of the CI filterbank 344, and the rest of the elements within the sound processing path segment 1751 (A), has been described above and will not be repeated. However, to facilitate a complete understanding of the embodiment of FIG. 17, a description of the sound processing path segment 1751(B) is provided below.

As noted, the sound processing path segment 1751(B) begins at HA filterbank 1788. Similar to the CI filterbank 344, the HA filterbank 1788 uses the pre-filtered input signal 343 to generate a suitable set of bandwidth limited (channelized) signals, sometimes referred to herein as a band-pass filtered signals, which represent the spectral components of the received sounds signal that are to be utilized for subsequent hearing aid sound processing. That is, the filterbank 1788 is a plurality of band-pass filters that separates the pre-filtered input signal 343 into multiple components, each one carrying a single frequency-limited sub-band of the original signal (i.e., frequency components of the received sounds signal as included in pre-filtered input signal 343). The channelized signals are referred to herein as being separated into, or forming, different sound processing channels. The number 'y' of channels and channelized signals generated by the filterbank 1788 may depend on a number of different factors including, but not limited to, processing strategy, recipient preference(s), etc.

At the output of the filterbank 1788, the channelized signals are referred to as pre-processed signals 1789. The pre-processed signals 1789 are provided to the post-filterbank processing module 1790. The post-filterbank processing module 1790 is configured to perform a number of sound processing operations on the pre-processed signals 1789. These sound processing operations include, for example gain adjustments (e.g., multichannel gain control), noise reduction operations, signal enhancement operations, etc., in one or more of the channels. After performing the sound processing operations, the post-filterbank processing module 1790 outputs a plurality of processed channelized signals 1791. The above description of hearing aid operations is given as an example only, and more sophisticated or less sophisticated hearing aid implementations are possible in accordance with embodiments presented herein.

As noted, the sound processing unit 1710 also includes a tinnitus relief system 1718 that operates with the electro-acoustic sound processor 1712. In the embodiment of FIG. 17, the tinnitus relief system 1718 comprises a tinnitus signal generator 1752, a channel profiler 1770, and a masker injection module 1754. Similar to the above embodiments, the tinnitus signal generator 1752 is configured to generate a channelized tinnitus masker signal that is represented in FIG. 17 by arrows 1749.

In the above cochlear implant embodiments, a generated channelized tinnitus masker signal typically included 'm' components, where 'm' was equal to the number of cochlear implant processing channels. In the embodiment of FIG. 17, the channelized tinnitus masker signal is configured to be injected into both segments of the sound processing path (i.e., into both the cochlear implant sound processing path 1751(A) and the hearing aid sound processing path 1751 (B)). As such, in the specific example of FIG. 17, the channelized tinnitus masker signal 1749 includes 'y+m' components so as to, potentially, allow injection of components into all of the cochlear implant sound processing channels and all of the hearing aid sound processing channels.

The tinnitus relief system 1718 also comprises a channel profiler 1770 to perform channel shaping of the channelized tinnitus masker signal 1749 and, accordingly, generate a shaped channelized tinnitus masker signal (shaped tinnitus masker signal) 1771. A masker signal injection module 1754 is configured to inject the shaped tinnitus masker signal 1771.

The injection of the shaped tinnitus masker signal 1771 into the cochlear implant sound processing channels is generally shown in FIG. 17 at 1756(A), while injection of the shaped tinnitus masker signal 1771 into the hearing aid sound processing channels is generally shown in FIG. 17 at 1756(B). As shown in FIG. 17, the processing location 1756(B) for injection of the shaped tinnitus masker signal 1771 is after the hearing aid post-filterbank processing module 1790. That is, one or more components of the shaped tinnitus masker signal 1771 are combined with, or otherwise applied to, signals 1791 in a corresponding hearing aid sound processing channel. As a result, the shaped tinnitus masker signal 1771 forms part of the one or more output signals generated by the hearing aid sound processing path 1751(B). It is also noted that injection of the shaped tinnitus masker signal 1771 occurs subsequent to noise reduction, signal enhancement, gain adjustment, and other sound processing operations that have the potential to affect the success of the tinnitus relief in some unintended manner.

As noted, the hearing aid sound processing path 1751(B) terminates at the re-synthesis module 1792. The re-synthesis module 1792 generates, from the processed channelized signals 1791 and the shaped tinnitus masker signal 1771, an output signal 1793. The output signal 1793 is used to drive an electroacoustic transducer, such as a receiver 1794, so that the transducer generates an acoustic signal for delivery to the recipient. In other words, the hearing aid sound processing path 1751(B) generates one or more output signals further comprise an electroacoustic transducer drive signal. As such, the re-synthesis module 1792 operates as an output block configured to convert the plurality of channelized signals into a plurality of output signals. Although not shown in FIG. 17, one or more operations may be performed after the re-synthesis operations of re-synthesis module 1792 and before the signal is sent to the receiver 1794. For example, a limiter or compressor, a maximum power output (MPO) stage, etc. could be added between the re-synthesis module 1792 and the receiver 1794.

FIG. 17 illustrates a specific embodiment in which the same channelized tinnitus masker signal may be delivered to both the hearing aid and cochlear implant sound processing paths. In alternative embodiments, each path may use separately generated channelized tinnitus masker signals that are generated in different manners.

As detailed above, presented herein are techniques for directly injecting a tinnitus relief signal into the channels of a hearing prosthesis. Also as detailed above, the tinnitus relief signal is injected into the back-end of the sound processing path so as to avoid processing operations that may interfere within the tinnitus relief (i.e., the masker signal is injected at a processing location after the majority of gain control and/or noise reduction has taken place).

It is to be appreciated that the embodiments presented herein are not mutually exclusive.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. An implantable hearing prosthesis, comprising:

at least one sound processing path that converts a sound signal into one or more output signals for use in compensation of a hearing loss of a recipient of the hearing prosthesis, wherein the sound processing path comprises a plurality of band-pass filters configured to generate a plurality of sound processing channels; and a tinnitus relief system comprising a tinnitus signal generator configured to generate a channelized tinnitus masker signal, and an injection module configured to inject the channelized tinnitus masker signal into the sound processing path such that the channelized tinnitus masker forms part of the one or more output signals, wherein the channelized tinnitus masker signal is generated by the tinnitus signal generator as a plurality of discrete components that each correspond to one of the plurality of sound processing channels.

2. The implantable hearing prosthesis of claim 1, wherein the tinnitus relief system is configured to inject the channelized tinnitus masker signal into the sound processing path at a processing location that is subsequent to noise reduction operations.

3. The implantable hearing prosthesis of claim 1, wherein the tinnitus relief system is configured to inject the channelized tinnitus masker signal into the sound processing path at a processing location that is subsequent to a group of operations comprising noise reduction, signal enhancement, and gain adjustment.

4. The implantable hearing prosthesis of claim 1, wherein the channelized tinnitus masker signal is generated by the tinnitus relief system as a plurality of discrete amplitudes at different frequency sub-bands that each correspond to a channel of the sound processing path.

5. The implantable hearing prosthesis of claim 1, wherein each of the plurality of components comprises a frequency-limited signal.

6. The implantable hearing prosthesis of claim 1, wherein each of the plurality of components comprises a full-band signal.

7. The implantable hearing prosthesis of claim 1, wherein the plurality of components each has a substantially equal amount of energy.

8. The implantable hearing prosthesis of claim 1, wherein the sound processing path comprises a channel selection module, and wherein the tinnitus relief system is configured to inject each of the plurality of components into one of the plurality of sound processing channels at a processing location that is prior to the channel selection module.

9. The implantable hearing prosthesis of claim 1, wherein the sound processing path comprises a channel selection module, and wherein the tinnitus relief system is configured to inject each of the plurality of components into one of the plurality of sound processing channels at a processing location that is subsequent to the channel selection module.

10. The implantable hearing prosthesis of claim 1, wherein the tinnitus relief system comprises a channel profiler configured to perform channel shaping on the channelized tinnitus masker signal before injection into the signal processing path.

11. The implantable hearing prosthesis of claim 1, wherein the tinnitus signal generator includes at least one signal modulator configured to at least one of randomly or pseudo-randomly modulate a noise signal to generate the channelized tinnitus masker signal.

12. The implantable hearing prosthesis of claim 11, wherein modulation of the noise signal is synchronized across a plurality of frequency components of the noise signal.

13. The implantable hearing prosthesis of claim 1, wherein the tinnitus relief system operates in accordance with one or more input parameters to generate and inject the channelized tinnitus masker signal into the sound processing path, and wherein the tinnitus relief system includes a user control module enabling user adjustment of one or more of the input parameters.

14. The implantable hearing prosthesis of claim 1, wherein the tinnitus relief system operates in accordance with one or more input parameters to generate and inject the channelized tinnitus masker signal into the sound processing path, and wherein the tinnitus relief system comprises an automated control module configured to adjust one or more of the input parameters based on at least one of an input sound pressure level of the sound signal, a sound environment of the hearing prosthesis, and voice activity detected in the sound signal.

15. The implantable hearing prosthesis of claim 1, wherein the hearing prosthesis is a cochlear implant, and wherein one or more output signals comprise a plurality of stimulation commands representative of electrical stimulation for delivery to a recipient.

16. The implantable hearing prosthesis of claim 1, wherein the hearing prosthesis is an electro-acoustic hearing prosthesis, and wherein the one or more output signals comprise a plurality of stimulation commands representative of electrical stimulation for delivery to a recipient and one or more electroacoustic transducer drive signals.

17. A method performed at an electric output implantable hearing prosthesis, comprising:

band-pass filtering a sound signal to generate a plurality of band-pass filtered signals;

generating, with a tinnitus signal generator, a channelized tinnitus masker signal comprising a plurality of discrete tinnitus relief signal components that each correspond to one of the plurality of band-pass filtered signals;

combining separate ones of the tinnitus relief signal components with each of a respective one of the plurality of band-pass filtered signals to generate a plurality of combined signals; and generating, based on the plurality of combined signals, one or more output signals for use in energizing one or more electrodes of the electric output implantable hearing prosthesis.

18. The method of claim 17, further comprising:

generating, based on the plurality of combined signals, one or more output signals for driving an electroacoustic transducer of the electric output implantable hearing prosthesis.

19. The method of claim 17, wherein the plurality of band-pass filtered signals are phase-free signals.

20. The method of claim 17, wherein each of the separate tinnitus relief signal components has a substantially equal amount of energy.

21. The method of claim 20, further comprising:

pseudo-randomly combining one or more of the separate tinnitus relief signal components that each has a substantially equal amount of energy with one or more of the plurality of band-pass filtered signals.

22. The method of claim 17, further comprising:

combining the separate tinnitus relief signal components with each of a respective one of the plurality of band-pass filtered signals after performing noise reduction operations on the plurality of band-pass filtered signals.

23. A sound processing unit of an implantable hearing prosthesis, comprising:

a plurality of band-pass filters configured to convert a sound signal into a plurality of channelized signals; and an output block configured to convert the plurality of channelized signals into a plurality of output signals;

a tinnitus signal generator configured to generate a channelized tinnitus masker signal comprising a plurality of discrete tinnitus relief signal components that each correspond to one of the plurality of channelized signals;

an injection module configured to apply one or more of the tinnitus relief signal components to corresponding ones of the channelized signals prior to conversion into the plurality of output signals.

24. The sound processing unit of claim 23, wherein one or more output signals comprise a plurality of stimulation commands representative of electrical stimulation for delivery to a recipient.

25. The sound processing unit of claim 23, wherein the one or more output signals comprise a plurality of stimulation commands representative of electrical stimulation for delivery to a recipient and one or more electroacoustic transducer drive signals.

26. The sound processing unit of claim 23, wherein the channelized tinnitus masker signal is applied to the channelized signals at a processing location that is subsequent to noise reduction operations.

27. The sound processing unit of claim 23, wherein the channelized tinnitus masker signal is applied to the channelized signals at a processing location that is subsequent to a group of operations comprising noise reduction, signal enhancement, and gain adjustment.

28. The sound processing unit of claim 23, wherein each of the plurality of separate components has a substantially equal amount of energy.

29. The sound processing unit of claim 23, further comprising:

a channel selection module configured to select a subset of the channelized signals for conversion by the output block into the plurality of output signals, wherein the channelized tinnitus masker signal is applied to the channelized signals at a processing location that is prior to the channel selection module.

30. The sound processing unit of claim 23, further comprising:

a channel selection module configured to select a subset of the channelized signals for conversion by the output block into the plurality of output signals, wherein the channelized tinnitus masker signal is applied to the channelized signals at a processing location that is subsequent to the channel selection module.

* * * * *